United States Patent [19]

Sampath et al.

[11] Patent Number: 4,985,729

[45] Date of Patent: Jan. 15, 1991

[54] CONTROL SYSTEM FOR REPRODUCTION MACHINES PROVIDING AN EXTENDED ALMOST JAM INTERVAL AND SHUTDOWN DELAY

[75] Inventors: Barbara A. Sampath; James F. Matysek, both of Fairport; Thomas N. Taylor, Rochester, all of N.Y.

[73] Assignee: Xerox Corporation, Stamford, Conn.

[21] Appl. No.: 246,725

[22] Filed: Sep. 12, 1988

[51] Int. Cl.[5] ..... G03G 21/00

[52] U.S. Cl. ..... 355/206; 355/308; 355/324

[58] Field of Search ..... 355/206, 208, 324, 308, 355/309; 227/2, 3

[56] References Cited

U.S. PATENT DOCUMENTS 4,497,569 2/1985 Booth, Sr. ..... 355/206

4,551,813 11/1985 Sanbayashi et al. ..... 355/206 X 4,589,080 5/1986 Abbott et al. ..... 364/552

4,785,329 11/1988 Walsh ..... 355/206

FOREIGN PATENT DOCUMENTS 60-179756 9/1985 Japan ..... 355/324

63-113473 5/1988 Japan ..... 355/324

63-116168 5/1988 Japan ..... 355/324

*Primary Examiner*—Fred L. Braun

*Attorney, Agent, or Firm*—Frederick E. McMullen

[57] ABSTRACT

A control system for the on-line binder of a reproduction machine which extends the operating window of certain binder components by an additional 'almost jam' interval in an attempt to prevent shutdown of the binder in the event that the component operating window is exceeded. Each 'almost jam' event is recorded in memory for use when servicing the machine.

7 Claims, 12 Drawing Sheets

CONTROL SYSTEM FOR REPRODUCTION MACHINES PROVIDING AN EXTENDED ALMOST JAM INTERVAL AND SHUTDOWN DELAY

The invention relates to a control system for reproduction machines, and more particularly, to a control system that provides an extended 'almost jam' interval during which certain machine components can operate even though the component nominal operating interval has been exceeded.

High speed reproduction machines are composed of a myriad of components and parts operated in predetermined timed synchronism with one another by a master controller to produce copies or prints of images. In these complex machines, correct timing of the individual parts is essential if the machine is to function in the manner intended without jamming or self-destructing. In this context therefore, the machine parts typically have an operating time interval or window of operation during which the part must operate. However, due to usage, wear, age, misalignment, misadjustment, and the like, the operating window for individual parts may become displaced, and when the change that occurs exceeds a permissible variation, a machine fault is declared and the affected part together with the machine, or at least the subsystem involved, stopped.

It would be desirable if, instead of stopping the machine or affected sub-system, operation could be continued even though the prescribed time window is exceeded. This would avoid the need to later restart the machine and to recover lost or damaged copies and prints that typically result from a premature stop of machines of this type. Further, by continuing operation beyond the nominal time span, the delay that normally attends shutdowns can be eliminated or at least reduced and customer satisfaction enhanced.

In the prior art, U.S. Pat. No. 4,589,080 to Abbott et al discloses a system in which statistical methods are used to predict when certain copier components will fail through comparison of the number of times the component or part is operated with stored values representing the number of times the part should operate normally. In U.S. Pat. No. 4,497,569 to Booth, Sr., there is disclosed a system in which the paper path of a copier is monitored at a series of monitoring stations along the paper path so that in the event of a jam, the failure of the copy sheet to arrive at the next monitoring station on time is detected and the copier shutdown.

In contrast to the prior art, the present invention provides, in a reproduction machine having plural discretely operating copy producing components synchronously operable in timed sequence with one another to produce copies, the combination of: first fault timing means for tolling a preset timed interval delimiting the copy producing cycle of at least one of the components of the machine, the first fault timing means on failure of the one component to complete its copy producing cycle within the preset timed interval enabling stopping the machine; second fault timing means adapted to intervene and delay stopping of the machine by the first fault timing means for a relatively short almost jam interval, the almost jam interval providing extra time for the one component to complete its copy producing cycle in an attempt to avoid the need to stop the machine, the second fault timing means on failure of the one component to complete its copy producing cycle within the almost jam interval enabling stopping the machine.

IN THE DRAWINGS

Figures 11A, 11B, 11C, 11D:
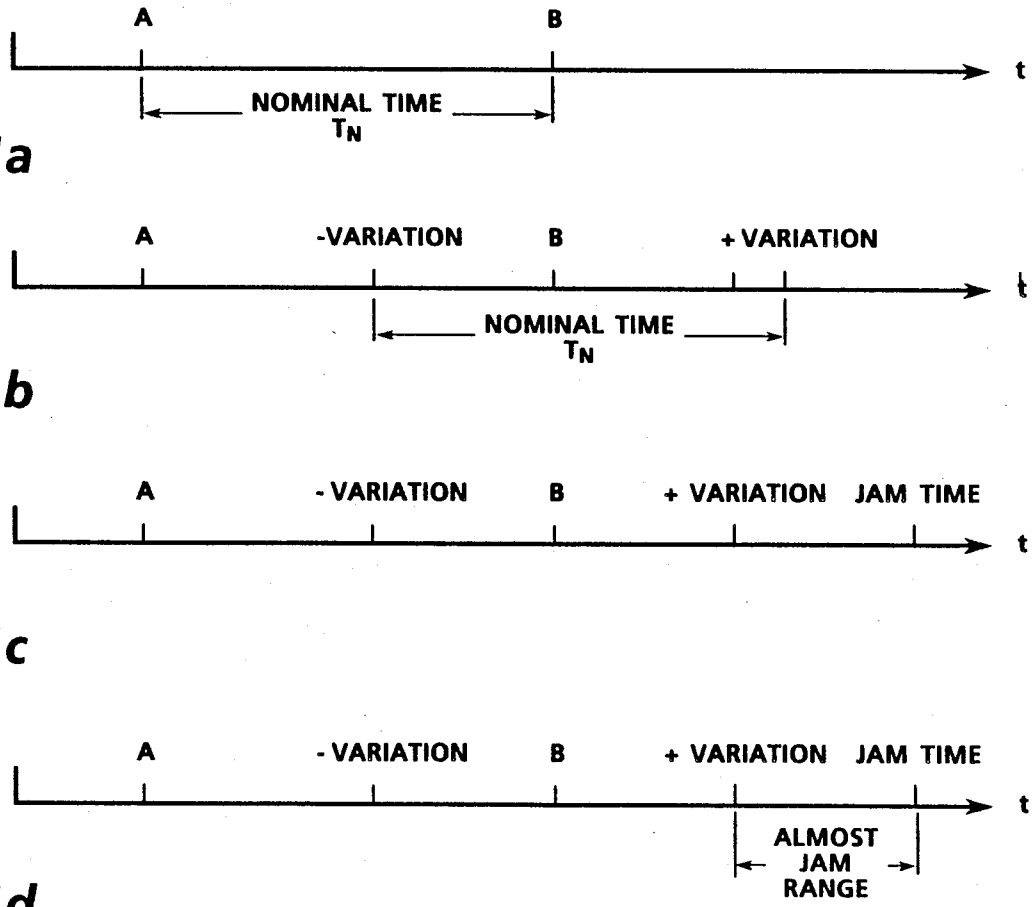
Figure 12:
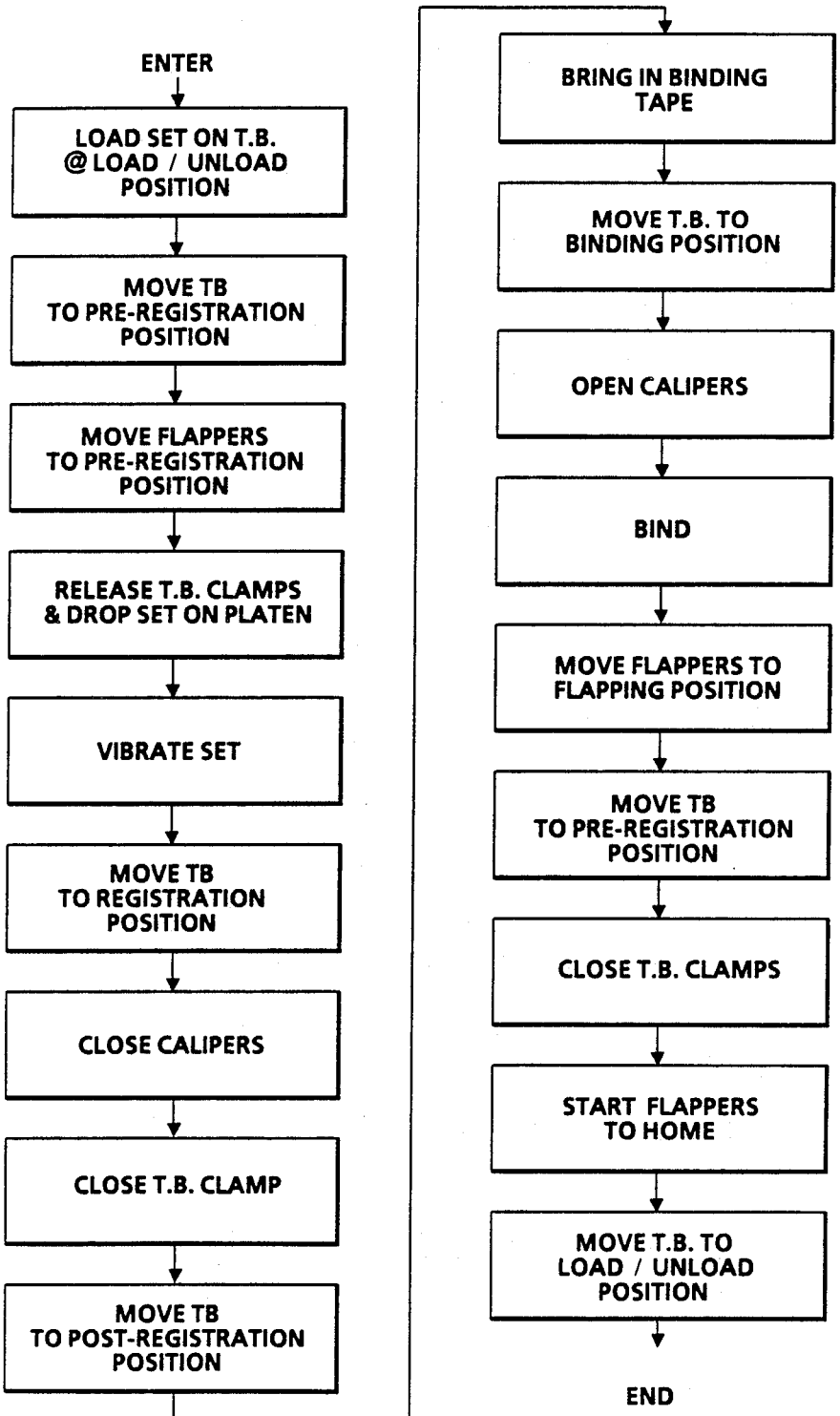

FIGS. 11*a*, 11*b*, 11*c* and 11*d* depict an exemplary Nominal Time span and the relationship thereto of the Almost Jam zone of the present invention; and FIG. 12 is a flow chart of the binding process practiced by the binding apparatus shown in FIGS. 5–9.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
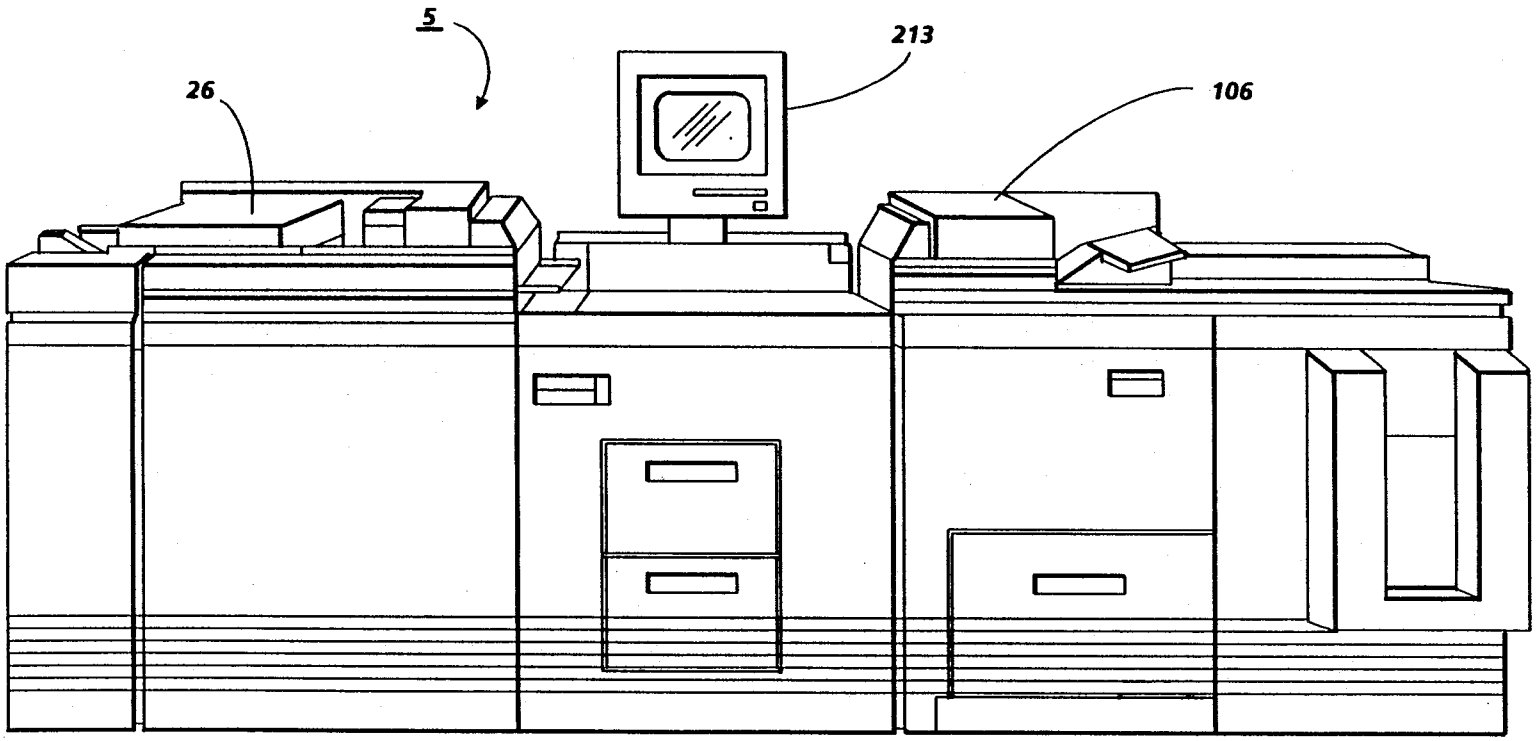
FIG. 1 is an isometric view of an illustrative reproduction machine incorporating the almost jam detection system of the present invention.
Figure 2:
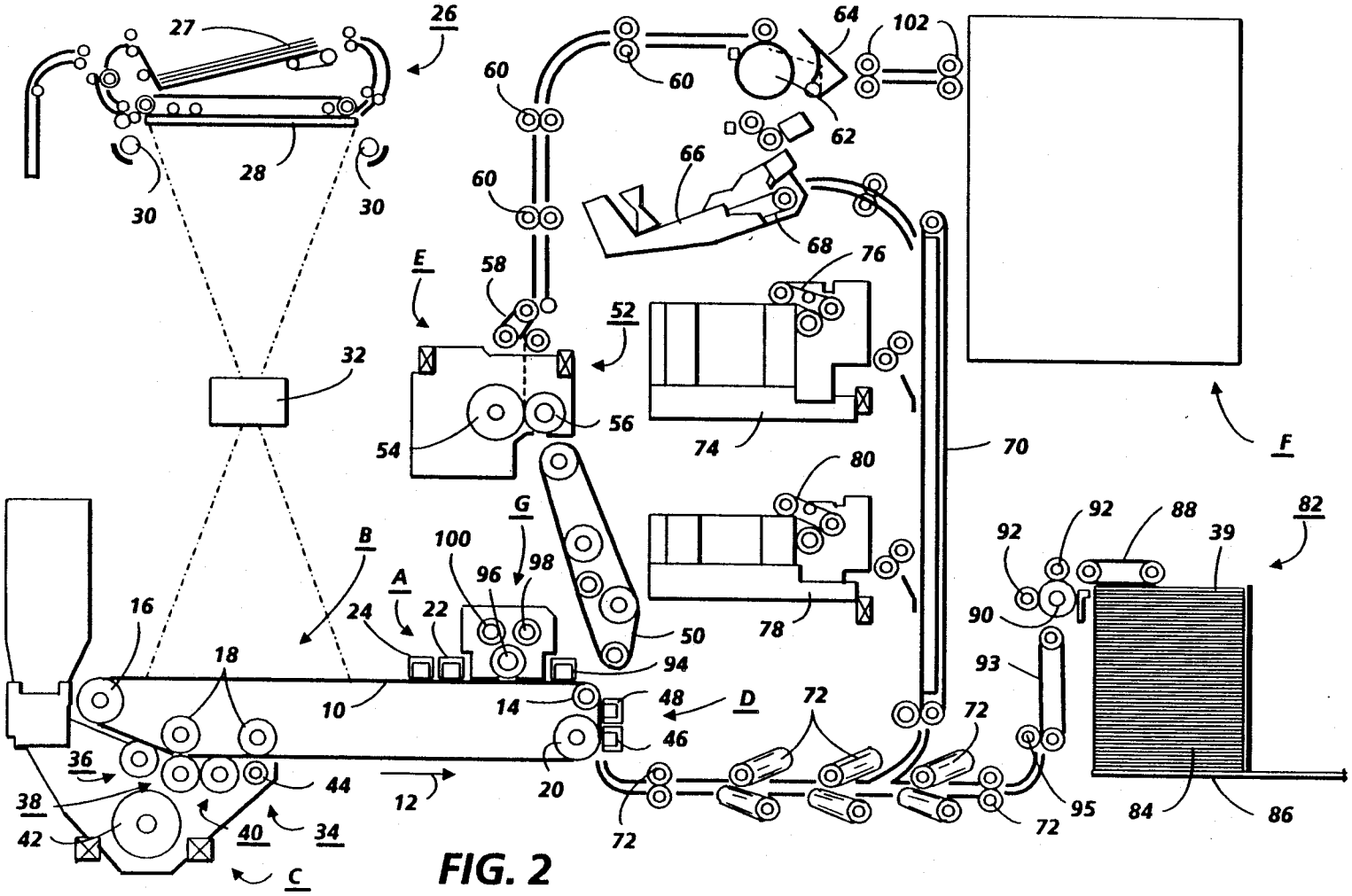
FIG. 2 is a schematic elevational view depicting various operating components and sub-systems of the machine shown in FIG. 1.
Figure 3:
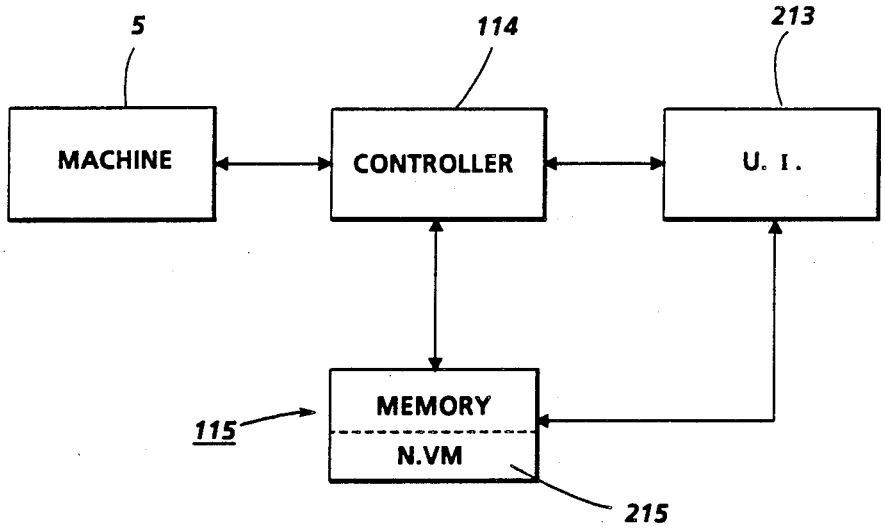
FIG. 3 is a block diagram of the operating control systems and memory for the machine shown in FIG. 1.

For a general understanding of the features of the present invention, reference is made to the drawings. In the drawings, like reference numerals have been used throughout to identify identical elements. Referring to FIGS. 1, 2, and 3, there is shown an electrophotographic reproduction machine 5 composed of a plurality of programmable components and sub-systems which cooperate to carry out the copying or printing job programmed through a touch dialogue User Interface (U.I.) 213.

Machine 5 employs a photoconductive belt 10. Belt 10 is entrained about stripping roller 14, tensioning roller 16, idler rollers 18, and drive roller 20. Drive roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents 27 from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet 39. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10.

Following transfer, a conveyor 50 advances the copy sheet 39 bearing the transferred image to fusing station E where a fuser assembly, indicated generally by the reference numeral 52, permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets 39 are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets 39 are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets 39. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95 and rolls 72 move the sheet to transfer station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

The various functions of machine 5 are regulated by a controller 114 which preferably comprises one or more programmable microprocessors. The controller provides a comparison count of the copy sheets, the number of documents being recirculated, the number of copy sheets selected by the operator, time delays, jam corrections, etc. Programming and operating control over machine 5 is accomplished through a U.I. 213. Operating and control information, job programming instructions, etc. are stored in a suitable memory 115 which includes both ROM and RAM memory types. There is also a Non-Volatile Memory (NVM) 215 for permanently retaining critical machine operating data and parameters, and for storing certain machine events such as jams, misfeeds, etc. Conventional sheet path sensors or switches may be utilized to keep track of the position of the documents and the copy sheets.

Figure 4:
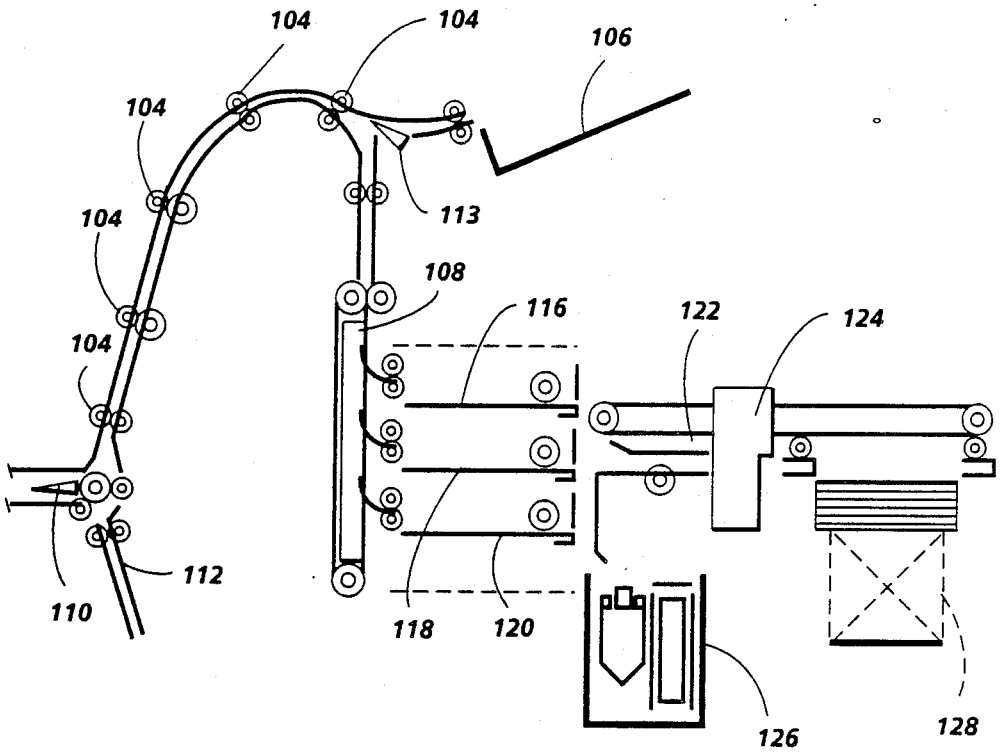
FIG. 4 is a schematic elevational view showing the finishing sub-system of the machine shown in FIG. 1.

Referring now to FIG. 4, finishing station F receives fused copies from rolls 102 (FIG. 2) and delivers them to gate 110. Gate 110 diverts the copy sheet to either registration rolls 104 or inverter 112. Copy sheets diverted to rolls 104 are advanced to gate 113 which diverts the sheets to either to top tray 106 or to vertical transport 108. Transport 108 transports sheets to any one of three bins 116, 118 or 120 which are used to compile and register sheets into sets. The bins are driven up or down by a bidirectional motor adapted to position the proper bin at the unloading position where a set transport 122 having a pair of set clamps is used to grasp and transport sets from the bins to either sheet stapling apparatus 124 when it is desired to staple the sets, or to binder 126 when it is desired to bind the sets, or to stacker 128 when unfinished set are desired.

Figure 5:
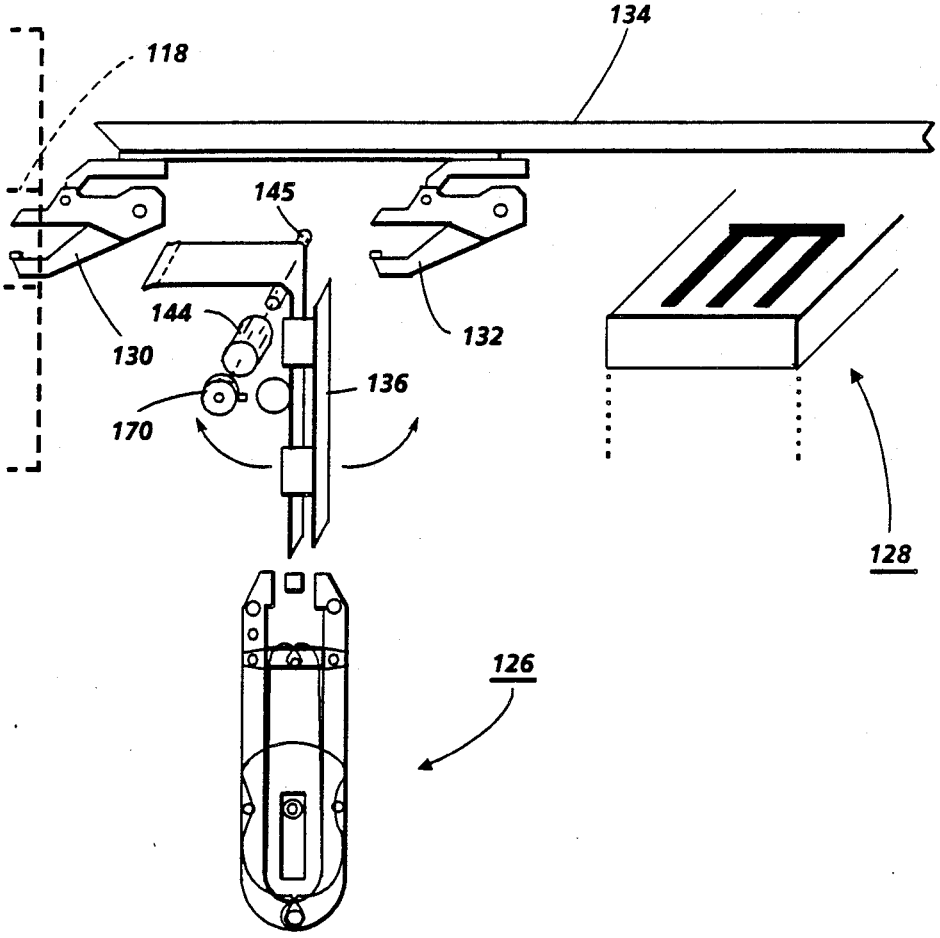
FIG. 5 is a schematic elevational view further illustrating the FIG. 4 finishing sub-system with the binding apparatus.

Turning now to FIG. 5, finishing station F has set clamps 130 and 132 mounted on a set transport carriage 134 and pneumatically driven by a compressor (not shown). Set clamp 130 removes sets 142 of copy sheets from bins 116, 118 and 120 for delivery to binding apparatus 126 at a load/unload position. Set clamp 132 removes the bound sets from binding apparatus 126 and delivers them to stacker 128, where they are stacked for delivery to the operator. Set clamps 130 and 132 are mounted fixedly on carriage 134 and move in unison therewith.

Figure 6:
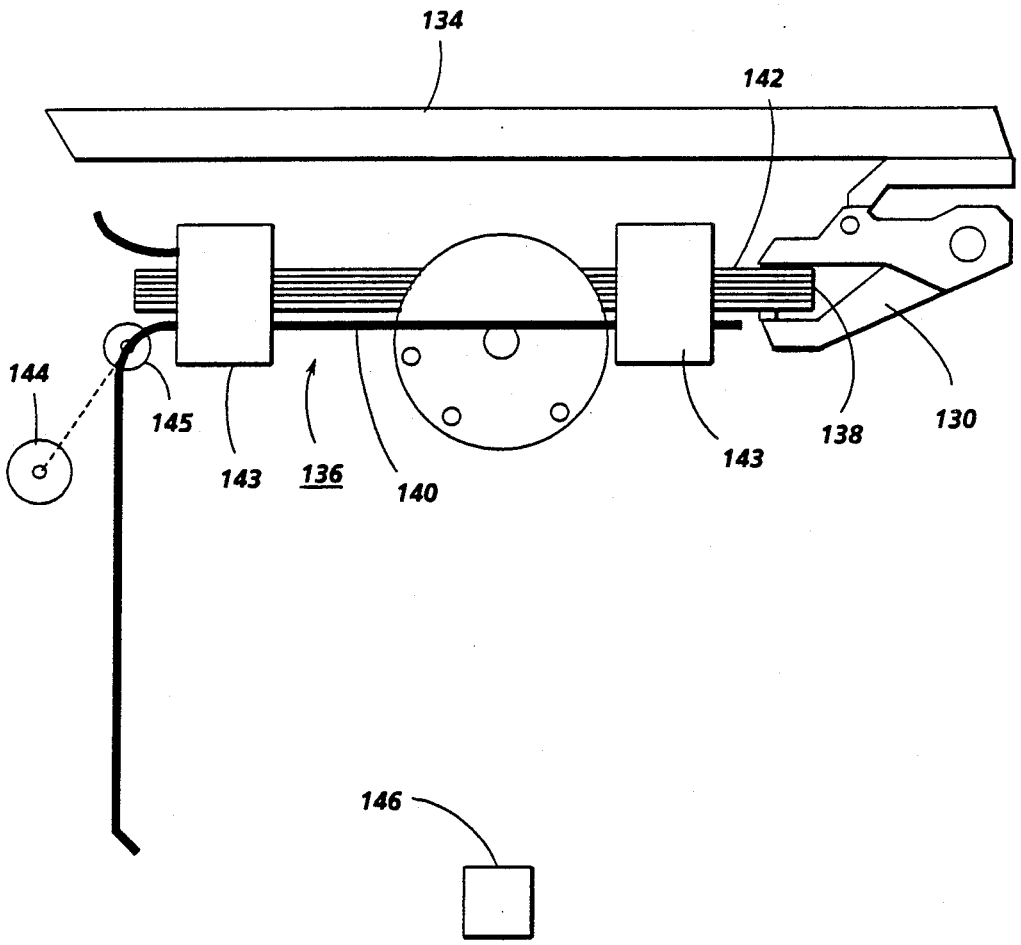
FIG. 6 is a schematic elevational view showing a set of copy sheets being received in the binding apparatus.

As shown in FIG. 6, set clamp 130 unloads the set to tilt bed 136 of binding apparatus 126. Tilt bed 136 positions the set 142 for binding. Once binding is completed, tilt bed 136 retrieves the bound set 142 for pick up by set clamp 132. Tilt bed 136 accepts sets 142 from clamp 130 with the spine 138, i.e. the edge to be bound, leading, and controls the position of the set 142 of copy sheets during the binding operation.

Tilt bed 136 includes a guide structure 140 with dual clamps 143 mounted thereon for holding the set of copy sheets thereon. Clamps 143 are operated pneumatically from a suitable source of air pressure (not shown). Guide structure 140 is mounted on a pivoting shaft 145 for rotation between vertical and horizontal positions. Guide structure 140 is oriented in a vertical position when non-operative as seen in FIG. 5. During binding, a bidirectional motor 144 pivots guide structure 140 to the horizontal load/unload position as seen in FIG. 6 where clamps 143 are opened to receive the next set 142 of copy sheets from clamp 130. A tilt bed position sensor 170 monitors the position of tilt bed 136. Clamps 143 clamp the set to the guide structure while motor 144 pivots structure 140 clockwise 90° from the horizontal position to the vertical pre-registration/post registration/park position shown in FIG. 7.

Figure 7:
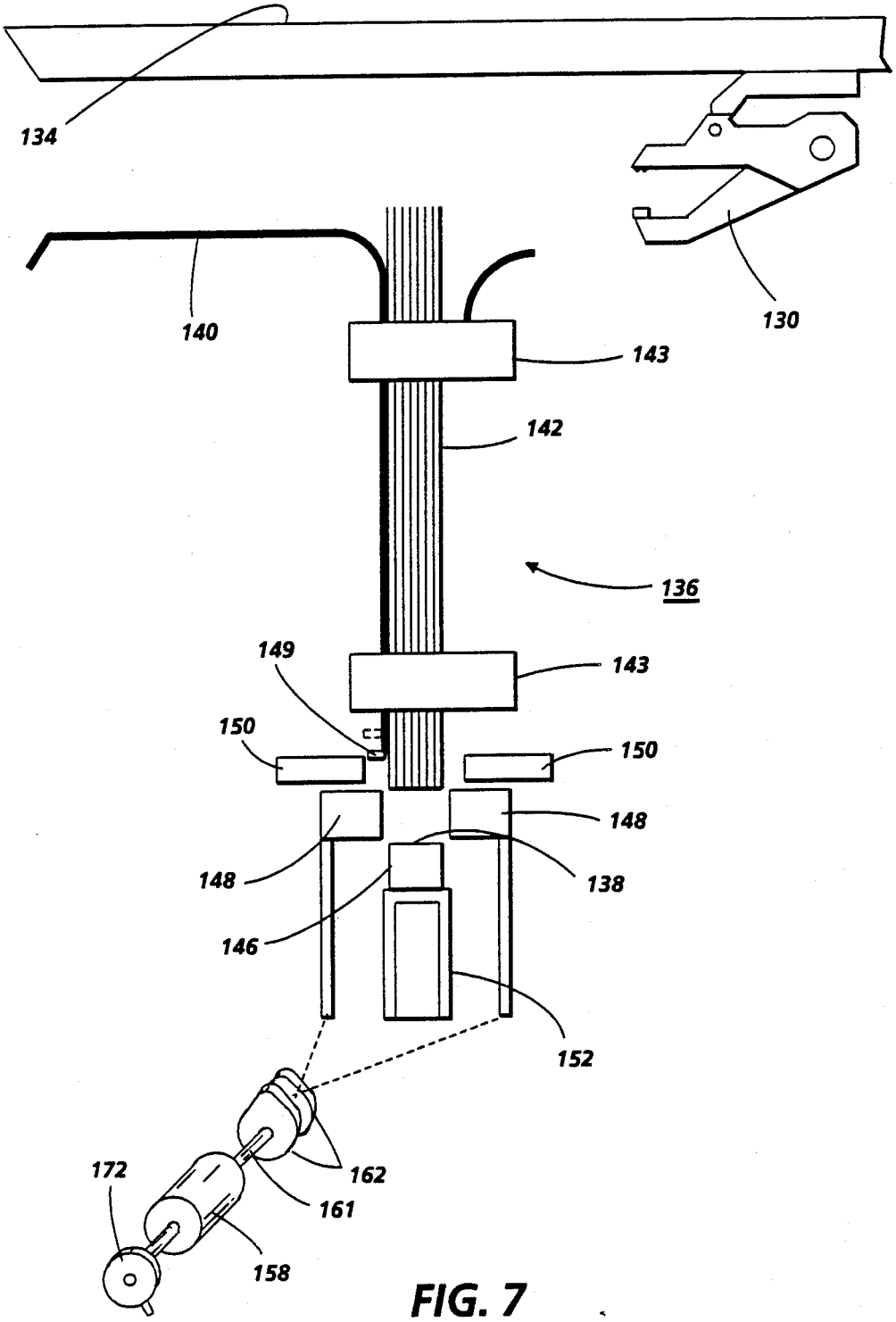
FIG. 7 is a schematic elevational view depicting the set of copy sheets in the pre-registration/post-registration position.
Figure 8:
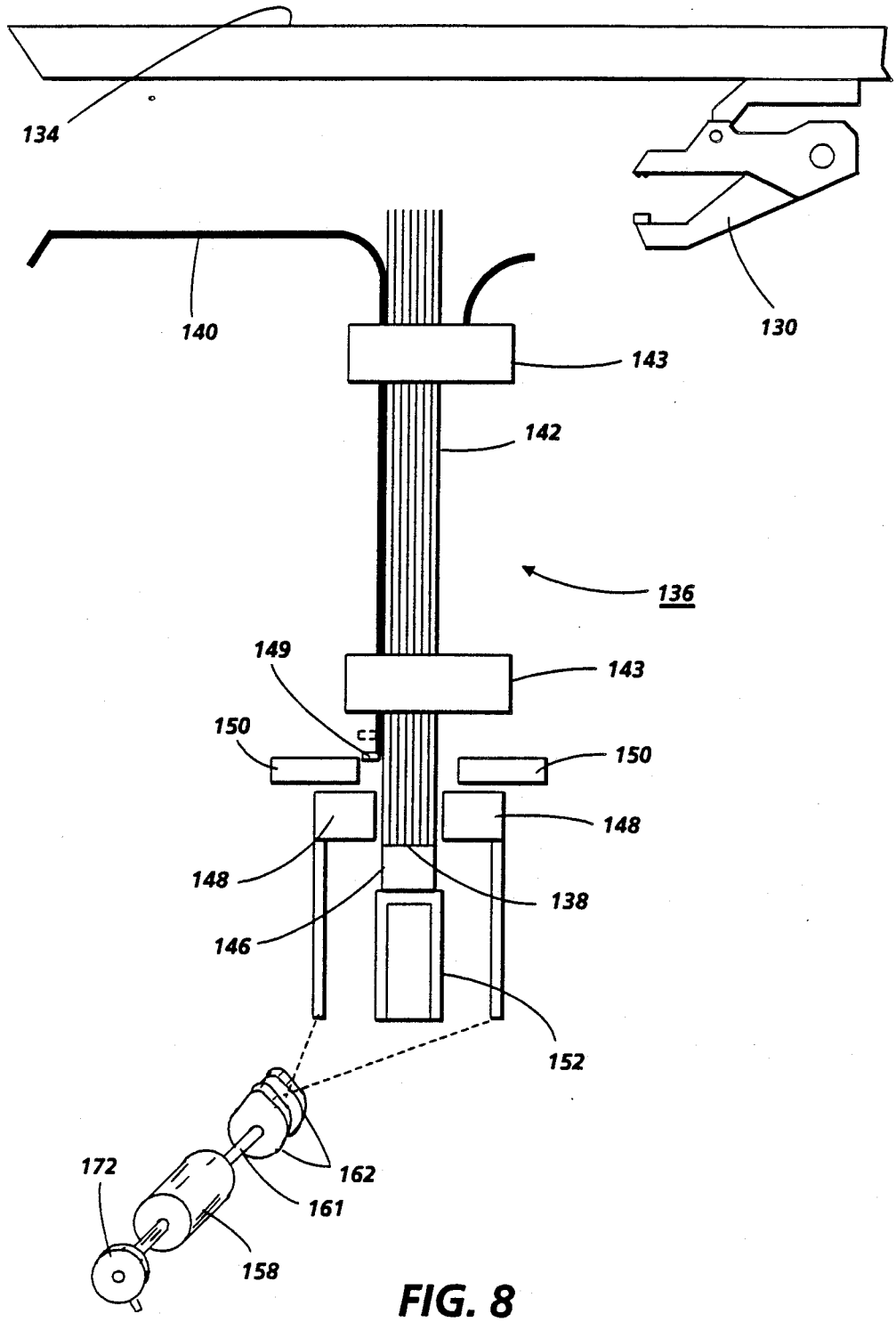
FIG. 8 is a schematic elevational view depicting the set of copy sheets being vibrated in the binding apparatus to register the edges thereof.
Figure 9:
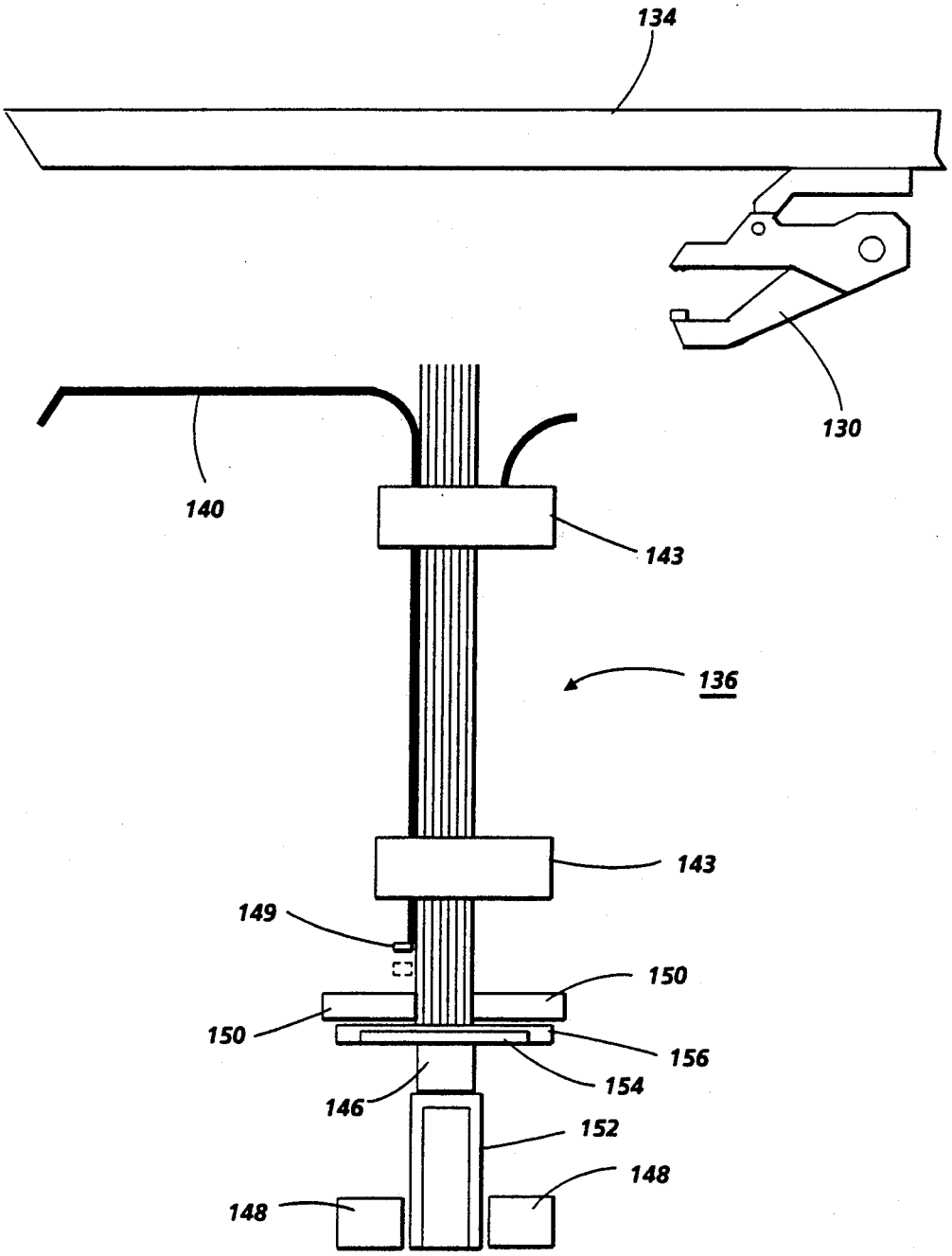
FIG. 9 is a schematic elevational view illustrating the binding apparatus positioning an adhesive strip on the spine of the set of copy sheets.
Figure 10:
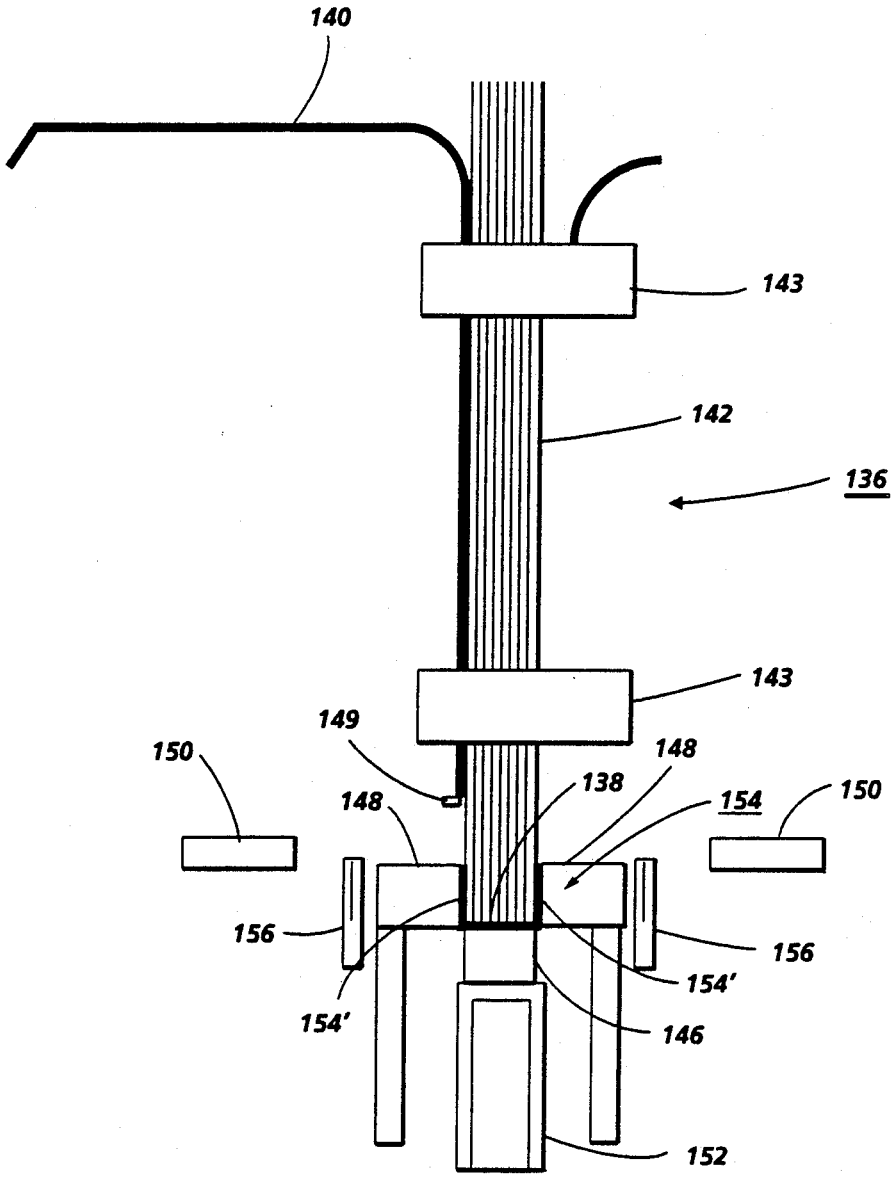
FIG. 10 is a schematic elevational view showing the binding apparatus bending the sides of the adhesive strip into contact with opposed sides of the outermost sheets of the set of copy sheets.

Referring to FIG. 7, two heated movable binder flappers 148 on either side of the binder head 146 form, when raised, a channel between which the book set 142 to be bound is positioned. Tilt bed 136 is moved in a downward direction until it engages a stop 149. Stop 149 is vertically movable between a first position for locating the guide structure during pre-registration/-post registration/park (FIG. 7) and vibration (FIG. 8) positions and a second position for locating the guide structure 140 during registration/binding as shown in FIGS. 9 and 10. Following engagement of guide structure 140 with stop 149, the set of copy sheets is correctly positioned between flappers 148 with spine 138 thereof abutting heated binding head or platen 146. At this time, clamps 143 open.

Flappers 148 are moved by cams 162 driven by a unidirectional motor 159 through cam shaft 161. A flapper position sensor 172 monitors the position of flappers 148. At the start of each binding cycle, cams 62 rotate for a segment to drive flappers 148 up from a home position to a pre-registration position (FIG. 7) and then drive flappers 148 down when pre-registration is completed (FIG. 9). During the next segment of cam rotation, cams 163 raise flappers 148 up to the tape-in-bind position, allowing springs (not shown) to pull flappers 148 in to the flap/press (flapping) position where the flappers press the sides 154' of the binding tape 154 against the outermost sheets of the set for binding as shown in FIG. 10. Movement of flappers 148 also pivots a pair of binding tape guides 156 out of the way. After binding, cams 162 raise flappers 148 up and away from the bound set to break any seal between the heated flappers and the bound set and move the flappers to home position.

Platen 146 provides a fixed surface for registering the set of copy sheets, and a source of heat for activating the glue on the adhesive tape during binding. A pair of calipers 150, which comprise air actuated paper clamps mounted above flappers 148, are provided for straightening the set of copy sheets at the completion of pre-registration and during the binding cycle. Calipers 150 are pressed against the set of copy sheets while the set is in contact with the adhesive tape 154 during the binding cycle as shown in FIG. 9 and before flappers 148 are raised to reduce flaring of sheets near the binding edge. A vibrator 152 attached to the underside of platen 146 vibrates platen 146 to register the copy sheets in preparation for binding as shown in FIG. 8. Following registration, clamps 143 of tilt bed 136 close and the tilt bed is moved vertically upward to space spine 138 of set 142 opposite platen 146.

Referring to FIG. 8, a length of adhesive binding tape 154 is interposed between platen 146 and spine 138 of set 142, the surface of the tape having a heat activated adhesive thereon positioned to contact spine 138 of the set 142 of copy sheets. A suitable tape feeder advances a length of tape 154 corresponding to the length of the copy sheet edge into position on cooperating tape guides 156. Tape guides 156 are then moved over platen 146 and flappers 148 while calipers 150 press against the sides of the set of copy sheets.

Turning now to FIG. 10, during the binding cycle, platen 146 and flappers 148 are heated to soften the adhesive on tape 154. Stop 149 is moved upwardly to a second position for engagement with guide 140 of tilt bed 136 on movement of bed 136 together with the set to binding position where spine 138 of set 142 is pressed into the softened adhesive on tape 154. Calipers 150 are disengaged from the set of copy sheets and flappers 148 raised to the tape-in-bind position to flap sides 154' of tape 154 so that the adhesive thereon presses against opposed outermost sheets of the set of copy sheets. After the adhesive tape is applied, flappers 148 are retracted and tilt bed 136 moved vertically upward with the bound set to separate the bound set from platen 146. Tilt bed 136 is then rotated 90° in a counter clockwise direction to the load/unload position for clamping and removal of the bound set by set clamp 132.

Referring now to FIG. 11*a*, two timing functions $T_1$ and $T_2$ corresponding, for example, to detection of the leading edge of a copy sheet 39 by two sensors along the paper path are shown. The interval $T_N$ therebetween is referred to as the Nominal Time, i.e., the interval or window that occurs under nominal operating conditions.

Variations in the machine operating times, however, will cause the timing functions $T_1$ and $T_2$ to shift with resultant displacement of the Nominal Time interval $T_N$. Displacement of the interval $T_N$ is referred to as the Nominal Range, an example of which is shown in FIG. 11*b*. Variations in machine operating times may be due to variations in line voltage, paper weight, humidity, wear, etc.

As will be understood, there is a point beyond the upper end of the Nominal Range $T_N$ where a jam will be declared because operation beyond that point cannot be tolerated. This is referred to as the jam time (JT), an example of which is depicted in FIG. 11*c*. The time interval between $T_N$ and JT is referred to herein as the Almost Jam zone and is shown by way of example in FIG. 11*d*. In the Almost Jam zone, the machine is operating below the expected level of performance, but the timing displacement is not yet a serious enough problem to cause the machine to shut down.

OPERATION

In the ensuing description, the timing values provided are for purposes of explanation only. Other timing values and relationships may be readily contemplated.

The software program "BindSet" [Copyright ©1985, 1986, 1987, 1988, Xerox Corporation, All Rights Reserved] for the below described binding cycle is found in Appendix A. "BindSet" includes tilt bed sub-routines "TiltBed", "TiltBedCycle", "TiltPause", and "ExtendedTiltBedFaultTimer"; vibrator sub-routine "RegisterSet"; flapper sub-routines "Flappers", "FlapperCycle", "FlapPause", and "ExtendedFlap- FaultTimer"; "DiagTimer" to record Almost Jam occurrences; and fault handling sub-routines "SSMgr.FaultHandler", "SetFault", and "CountFault".

Referring to FIGS. 5–12 and the software programs of Appendix A, on expiration of a timed interval of 310 milliseconds (ms.) after clamps 143 on tilt bed 136 are energized to receive and load the next set of copies to be bound, tilt bed motor 144 is energized (TiltBed[-preReg]BindSet routine) in the forward direction (TILT$FWD<on-TiltBed routine) to rotate tilt bed 136 with set 142 in a clockwise direction from the horizontal load/unload position to the vertical pre-registration/post registration/park position shown in FIG. 7. Motor 144 remains energized until tilt bed position sensor 170 (TILT#POSB=low-TiltBedCycle routine) indicates that tilt bed 136 is properly positioned. A time stamp function ("ReadGlobalRTC"-TiltBedCycle routine) is used to determine the amount of time this motion takes.

If tilt bed 136 does not reach the correct position within a timed interval TN of 460 ms. after motor 144 is energized, the tilt bed timing function enters the Almost Jam zone. The binding process is continued for another 80 ms. as if tilt bed 136 has reached the pre-registration position, and a separate Almost Jam timer is set up (ExtendedTiltBedFaultTimer routine) to continue monitoring tilt bed position sensor 170 (TILT#POSB). At the same time, the count on a counter (DiagTimer routine) in NVM 215 (Tilt Bed Slow to Pre-Registration Position Status) is incremented by one to indicate that the Nominal Range interval $T_N$ was surpassed. If the tilt bed does not reach the pre-registration position in a total elapsed time of 540 ms., a tilt bed fault is declared ("Start SSMgr. Fault Handler[tbFault,.set]"-ExtendedTiltBedFaultTime routine) and the finishing station F shut down ("START FBN from MLT.Shut Down . . . "-FaultHandler routine). The SetFault routine is called which sets the appropriate identifying byte in the fault table and the CountFault routine is called to log the fault occurrence in NVM 215.

Flapper motor 158 (FLAP$MTR<on-FlapperCycle routine) is energized until a flapper position sensor 172 (FLAP#POS) indicates that flappers 148 have moved from the home position to the pre-registration position. A time stamp function (ReadGlobalRTC) is used to determine the amount of time required for this. If flappers 148 do not reach the pre-registration position within a timed interval TN of 200 ms. after motor 158 is energized, the flapper timing function enters the Almost Jam zone. The binding process is continued for another 100 ms. as if flappers 148 had reached pre-registration position, and a separate Almost Jam timer (ExtendedFlapFaultTimer routine) is set up to continue monitoring flapper position sensor 172. The count on a counter (DiagTimer routine) in NVM 215 ("Flappers Slow to Pre-Registration Position Status"), is incremented by one to indicate that the Nominal Range interval TN for flapper pre-registration was surpassed. If the flappers do not reach the pre-registration position in a total elapsed time of 300 ms., a fault (START SSMgr.FaultHandler [flapFault . . . Set]-FlapperCycle routine) is declared and the finishing station shut down.

Following completion of the pre-registration cycle, tilt bed clamps 143 are opened, allowing the set 142 to drop onto platen 146 as shown in FIG. 8. Vibrator 152 is started (RegisterSet routine) to register the set.

After 100 ms., and while registration is in process, the tilt bed 136 is brought down.

(TiltBed[.registration]-BindSet routine). For this, tilt bed motor 144 is energized in the forward direction (TILT$FWD<on-TiltBed routine) to move tilt bed 136 down until sensor 170 (TILT#POSB-TiltBedCycle routine) indicates that tilt bed 136 is in registered position. If the tilt bed does not reach the registration position in a total elapsed time of 260 ms., a fault is declared ("Start SSMgr. Fault Handler[tbFault,.set]"-TiltBedCycle routine) and the finishing station F shut down ("START FBN from MLT.Shut Down . . . "-FaultHandler routine). The SetFault routine is called which sets the appropriate identifying byte in the fault table and the CountFault routine called to log the fault occurrence in NVM 215.

Following an interval of 200 ms. after registration, calipers 150 are closed (CAL$AIR<on-BindSet routine) and 200 ms. after calipers 150 are closed, tilt bed set clamps 143 (TILT$CLAMP<on-BindSet routine) are activated to grasp the set 142. Following 280 ms., tilt bed motor 144 is reversed (START TiltBed [pre-Reg]-BindSet routine) to raise tilt bed 136 to the post-registration (i.e., same as pre-registration) position (TILT$REV<on-TiltBed routine). If the tilt bed does not reach the post-registration position in a total elapsed time of 260 ms., a tilt bed fault is declared ("Start SSMgr. Fault Handler[tbFault,.set]"-TiltBedCycle routine) and the finishing station F shut down ("START FBN from MLT.Shut Down . . . "-FaultHandler routine). The SetFault routine is called which sets the appropriate identifying byte in the fault table and the CountFault routine is called to log the fault occurrence in NVM 215.

Tape 154 is inserted (Flappers [.tape In Bind]-BindSet routine) (FIG. 9).

During binding (FIG. 10), the tilt bed 136 is moved to the binding position (TiltBed[.binding]-BindSet routine), the calipers are opened (CAL$AIR<on-BindSet routine) and the flappers 148 are moved to the flapping position (Flappers[.flapping]-BindSet routine). After flappers 148 reach flapping position and following a calculated delay (BinderFlapTime - 530 ms.), tilt bed set clamps 143 are opened (TILT$CLAMP>.off-BindSet routine). The set is gripped by flappers 148 at this time. After a 230 ms. wait to allow tilt bed clamps 143 to open, tilt bed motor 144 is energized in reverse (TILT-$REV<on-TiltBed routine) until tilt bed position sensor 170 (TILT#POSB=low-TiltBedCycle routine) indicates that the pre-registration (i.e., same as post-registration) position has been reached. A time stamp function is used to determined the amount of time this motion takes. If tilt bed 136 does not reach the post-registration position within a timed interval $T_N$ of 220 ms. after motor 144 is energized, the tilt bed timing function enters the Almost Jam zone. The binding process is continued for another 40 ms. as if tilt bed 136 had reached the binding position, and a separate Almost Jam timer is set up in software (ExtendedTiltBedFaultTimer-routine) to continue monitoring tilt bed position sensor 170 (TILT#POSB). At the same time, the count on a counter (DiagTimer routine) in NVM 215 (Tilt Bed Slow to Post-Registration Position Status) is incremented by one to indicate that the Nominal Range interval TN was surpassed. If the tilt bed does not reach the post-registration position in a total elapsed time of 260 ms., a tilt bed fault is declared ("Start SSMgr. Fault Handler[tbFault,.set]"-ExtendedTiltBedFaultTime routine) and the finishing station F shut down ("START FBN from MLT.Shut Down . . . "-FaultHandler routine). The SetFault routine is called which sets the appropriate identifying byte in the fault table and the CountFault routine is called to log the fault occurrence in NVM 215.

Following binding, tilt bed clamps 143 are closed (TILT$CLAMP<.on-BindSet routine) and flapper motor 158 is energized to move flappers 148 to the home position (START Flappers [home]-BindSet routine). After flappers 148 have released the book, tilt bed motor 144 is energized in reverse (TILT$REV<on-TiltBed routine) until tilt bed position sensor 170 (TILT#POSB=low-TiltBedCycle routine) indicates that tilt bed 136 has been returned to the load/unload position. A time stamp function is used to determine the amount of time this motion takes. The finished set remains clamped by clamps 143 of tilt bed 136 until set clamp 132 is energized to clamp and unload the bound set from tilt bed 136 and transport the finished set to stacker 128.

Each Almost Jam that occurs is recorded in NVM 215 in an Almost Jam log for future reference and use in servicing printer 5, identifying current problems, and predicting future problems and failures. For this purpose, the machine Tech Rep can access the Almost Jam log in NVM 215 during servicing to obtain a printout listing various selected information and data regarding the occurrence of Almost Jams. For example, the programs "NVMCounterCmd/Compute MCBAJ" and "NVMCounter Cmd/ComputeTop15MCBAJ" of Appendix B. [Copyright ©1985, 1986, 1987, 1988, Xerox Corporation, All Rights Reserved] allow the Tech Rep to receive information and data identifying the Mean Copies Between Almost Jams (MCBAJ) and the top 15 of the Mean Copies Between Almost Jams.

While the invention has been shown and described in connection with a binding apparatus, it will be understood that the invention may be used to control the operation of other and different components and subsystems of reproduction machines.

While the invention has been described with reference to the structure disclosed, it is not confined to the details set forth, but is intended to cover such modifications or changes as may come within the scope of the following claims.

We claim:

APPENDIX A

```
BinderImpl.sequel

--File:  BinderImpl  Process:BindSet
--=================================================================
--This process sequentially controls the functions of the binder.  It is
--Initiated by Unload Set in the SetPath Module when a set is delivered to
--the Tilt Bed for binding.  The Tilt Bed will already be in the Load/
--Unload position upon set delivery.

--The Bind Set Process will leave the Tilt Bed Clamp energized.  The
--Unload Set Process will de-energize this clamp when a set is ready
--to be removed from the bin.
--=================================================================
BindSet:  PUBLIC PROCESS[setSize: SHORT CARDINAL] =

  ENTER

    OS.SetPriority[.high];

    --=================================================================
    --Clear the tilt bed ready event flag so the set transport does not move
    --to pickup sets.
    --=================================================================
    tiltBedReady ← FALSE;
    FBNEvents.tiltBedReady↑ ← .clear;


    -- The subsystem manager sets the bindCycle to FALSE in ShutDown
    -- UnloadSet sets and clears bindCycle

    --=============================================================
    --If there is a set in the tilt bed, begin the binding process
    --=============================================================
    IF FBNIO.TILT#SETIN↑ = .high THEN

      FBNIO.TILT$CLAMP↑ ← .on;          --Clamp the Set
      WAIT 140 MS;                      --wait 150 ms for the xport to make it home
      FBNIO.GUIDE$SUP↑ ← .on;           --Pull down set supports
      WAIT 170 MS;                      --Wait 160 for the tape feed cycle
```

```
TiltBed[.preReg];                    --TB to Pre Reg Position

-----------------------------------------------------------
-- If the set size is 51 sheets or greater, we want to decrease the
-- possibility of the flaring on curled large sets from missing outer
-- pages of the bound set or misregistered sets
-----------------------------------------------------------
IF setSize > 50 THEN
   FBNIO.CAL$AIR↑ ← .on;
   WAIT 190 MS;
END IF;

Flappers[.preReg];                    --Flappers to pre reg position

FBNIO.TILT$CLAMP↑ ← .off;             --Drop set on platen
FBNIO.CAL$AIR↑ ← .off;
WAIT 160 MS;                          --Wait for pages to settle

FORK RegisterSet[] DURING             --Start registering the set
  WAIT 100 MS;
  START TiltBed[.registration];
END FORK;

WAIT 200 MS;                         --Wait for set to settle after vibration

FBNIO.CAL$AIR↑ ← .on;                --Caliper the set after registation

WAIT 200 MS;                         --Wait for calipers to close

FBNIO.TILT$CLAMP↑ ← .on;             --Close the tilt bed clamp

SELECT Binder.flapTime FROM          --Determine the flapping time
  CASE > 1500 MS:
    Binder.flapTime ← 1500 MS;
  CASE < 530 MS:
    Binder.flapTime ← 530 MS;
END SELECT;

FORK CalculateBindingTime[setSize] DURING       --Wait for tb clamp to close
  WAIT 280 MS;
END FORK;

START TiltBed[.preReg];                         --Move tilt bed to post reg

IF FBNEvents.cutTapeComplete↑ = .set THEN       --Make sure the tape is done
  Flappers[.tapeInBind];                         --Bring the tape in
ELSE
   ---------------------------------------------------------------
   --Determine which process is holding up the tape cycle
   ---------------------------------------------------------------
 IF CANCELLABLE [FeedTape]  THEN
    START SSMgr.FaultHandler[.tapeHomeFlt, .set];
  ELSE
   START SSMgr.FaultHandler[.tapeRevHomeFlt, .set];
  END IF;
END IF;

TiltBed[.binding];                              --Bring the set down on the tape

-------------------
--Binding the set
-------------------
adjustedBindingTime ← bindingTime - 300 MS;       --Wait for calipers
WAIT adjustedBindingTime;                         --Remaining binding time
FBNIO.CAL$AIR↑ ← .off;                                    --Open calipers
```

```
    ------------------
    --Flapping the set
    ------------------
    WAIT 300 MS:
    Flappers[.flapping];                          --Bring flappers up
    adjustedFlapTime ← Binder.flapTime - 530 MS:
    WAIT adjustedFlapTime:                        --Wait before re-gripping set
    FBNIO.TILTSCLAMP↑ ← .off:                                  --Release set

    WAIT 230 MS:                                  --Wait for tb clamp to open

    FORK TiltBed[.preReg] DURING                   --Move tb to regrip position
                                                  --Calculate the cure time here
      calculatedCureTime ← (RECAST[convertedSetSize, REALTIME] * 420);
    END FORK:

    FBNIO.TILTSCLAMP↑ ← .on:                        --Close the tilt bed clamp

      WAIT 80 MS;                                     --Wait for tb clamp to close
      START Flappers[.home];                          --Start to unload

      WAIT 160 MS;                                    --wait until the flappers
      release the book
      TiltBed[.loadUnload];

      IF FBNIO.TILT#SETIN↑ = .high THEN     --See if book is still in the tilt bed
        START SSMgr.UpdateCounter[.increment,.setsBound];
      ELSE
        START SSMgr.FaultHandler[.tiltBedNoSetJam, .set];
      END IF;

      IF FBNIO.TAPE#HOME↑ = .high THEN       --Check if the tape was placed on
      book
        START SSMgr.FaultHandler[.tapeNotStuckToBook, .set];
      END IF;

    --There is not a set in the tilt bed when this process was started
    ELSE
      START SSMgr.FaultHandler[.tiltBedNoSetJam, .set];
    END IF;

    ---------------------------------------------------------------------
    --Clear Tape cut and feed events here to be used for synchronization of
    --the next cycle.  The Tape feed and cut process proceeds independently
    --of the rest of the binding cycle and must be finished by the time the
    --flappers move to tape-in-guide position.  We cannot move the flappers
    --if the tape process is not completed.  Feed and Cut tape events will
    --be clear before the next bind cycle.
    ---------------------------------------------------------------------

    FBNEvents.cutTapeComplete↑ ← .clear;
    FBNEvents.feedTapeComplete↑ ← .clear;


    WILL
      FBNIO.CAL$AIR↑ ← .off;
      CANCEL TiltBed;
      CANCEL Flappers;
  END PROCESS BindSet;
END MODULE BinderImpl;
```

```
-- File:  BinderImpl  Process:TiltBed
--=================================================================
--TiltBed[TBPosition];
--This process cycles the tilt bed to the position indicated in the
--passed parameter.
--The correct tilt bed motor output direction is turned on and the
--process TiltBed Cycle is called to detect the next transition of the
--position sensor.  In some of the cycles a minimum time wait is
--inserted to keep the binding time constant.  This is to compensate
--for tilt bed motions that are accomplished sooner than a minimum time.
--Also, in certain cycles where it is possible, if the cycle time is longer
--than it should be, the binding process continues and an extended fault time
--is started.  This to compensate for a slower than expeced tilt bed cycle.
--When the maximum fault time is started, a log is kept in NVM to
--indicate the worst case motion time.
-----------------------------------------------------------------
TiltBed: PUBLIC PROCESS[cycleNext: Binder.TBPosition] =

  ENTER

    OS.SetPriority[.high];

    --Variable initializations
    tiltBedMinTime ← 0 MS;
    tiltBedMaxTime ← 0 MS;
    tiltBedFault ← FALSE;
    tiltBedDNMove ← FALSE;

    TBcontrolBlock: SELECT cycleNext FROM

      CASE = .loadUnload:
        SELECT currentTiltBedPosition FROM
          CASE = .preReg, = .regrip:
            nextTiltBedPosition ← .loadUnload;
            tiltBedFaultTime ← tiltBedLoadUnloadJamTime;
            tiltBedMinTime ← 680 MS;
            tbFault ← .tbLoadUnloadFlt;
            FBNIO.TILT$REV↑ ← .on;
            TiltBedCycle[];

            ---------------------------------------------------------
            --We're taking another time stamp after all the waits and
            --extentions to calculate the book cure time (only if binding)
            --ONLY IF we are not running a diagnostic programs
            ---------------------------------------------------------
            IF (SSMgr.diagProgramRunning =  .noProgram) AND (bindCycle) THEN
              OS.ReadGlobalRTC[@tbTimeStamp3];
              IF calculatedCureTime >
                     (tbTimeStamp3 - SetPath.setXptToPickup) THEN
                cureTime ← calculatedCureTime -
                      (tbTimeStamp3 - SetPath.setXptToPickup);

                ---------------------------------------------
                --Maximum value for a WAIT is 32 seconds
                --Our total curetime cannot exceed 64 seconds
                --for this code to work
                ---------------------------------------------
                IF cureTime > 32000 MS THEN
                  theRest ← cureTime - 32000 MS;
                  WAIT 32000 MS;
                  WAIT theRest;
```

```
        ELSE
          WAIT cureTime;
        END IF;
      END IF;
    END IF;
    IF NOT tiltBedFault THEN
      FBNEvents.tiltBedReady↑ ← .set;
      tiltBedReady ← TRUE;
    END IF;

  CASE = .loadUnload:
    IF NOT tiltBedFault THEN
      FBNEvents.tiltBedReady↑ ← .set;
      tiltBedReady ← TRUE;
    END IF;

  OTHERWISE:                                    --we lost our position
    START SSMgr.FaultHandler[.tbLoadUnloadFlt, .set];
END SELECT;

CASE  = .preReg:
  SELECT currentTiltBedPosition FROM
    CASE = .loadUnload :
      nextTiltBedPosition ← .preReg;
      tiltBedFaultTime ← tiltBedPreRegJamTime;
      tiltBedMinTime ← 460 MS;
      tiltBedMaxTime ← 540 MS;
      tbFault ← .tbPreregFlt;
      FBNIO.TILT$FWD↑ ← .on;
      TiltBedCycle[];

    CASE = .binding:
      nextTiltBedPosition ← .preReg;
      tiltBedFaultTime ← tiltBedRegripJamTime;
      tiltBedMinTime ← 220 MS;
      tiltBedMaxTime ← 260 MS;
      tbFault ← .tbPreregFlt;
      FBNIO.TILT$REV↑ ← .on;
      TiltBedCycle[];

    CASE = .registration:
      nextTiltBedPosition ← .preReg;
      tiltBedFaultTime ← tiltBedPostRegJamTime;
      tbFault ← .tbPostRegFlt;
      FBNIO.TILT$REV↑ ← .on;
      TiltBedCycle[];
      WAIT 250 MS;        --wait for bi-directional motor

    OTHERWISE:            --we lost our position
      START SSMgr.FaultHandler[.tbPreregFlt,.set];
  END SELECT;

CASE = .registration:
  IF currentTiltBedPosition = .preReg THEN
    nextTiltBedPosition ← .registration;
    tiltBedFaultTime ← tiltBedRegJamTime;
    tbFault ← .tbRegFlt;
    FBNIO.TILT$FWD↑ ← .on;
    TiltBedCycle[];
  ELSE                                          --we lost our position
    START SSMgr.FaultHandler[.tbRegFlt, .set];
  END IF;
```

```
CASE = .binding:

  IF currentTiltBedPosition = .preReg THEN
    nextTiltBedPosition ← .binding;
    tiltBedFaultTime ← tiltBedBindPosJamTime;
    tiltBedMinTime ← 200 MS;
    tiltBedMaxTime ← 260 MS;
    tbFault ← .tbRegFlt;        --CHANGE LATER TO BINDING FAULT !!!!@@@@??
    FBNIO.TILT$FWD↑ ← .on;
    TiltBedCycle[];
  ELSE                                          --we lost our position
    START SSMgr.FaultHandler[.tbRegFlt,.set];
  END IF;

CASE = .initialize:
  IF FBNIO.TILT#SETIN↑ = .low THEN        --don't init if set in t.b.
    WAIT 250 MS;                          --for bi-directional motor
    FBNIO.TILT$FWD↑ ← .on;
    currentTiltBedPosition ← .unknown;

    DETECT

      CASE ANYTIME  FBNIO.TILT#HOME↑ = .low:     --home sensor is reached
         nextTiltBedPosition ← .initialize;
         tbFault ← .tbParkFlt;              --NEED HOME FAULT!!!###
        DETECT
              CASE ANYTIME FBNIO.TILT#POSB↑ = .low:
                 FBNIO.TILT$FWD↑ ← .off;
              CASE tiltBedInitJamTime:   --from home to sensor b
                 FBNIO.TILT$FWD↑ ← .off;
                 START SSMgr.FaultHandler[tbFault, .set];
                 CANCEL ExtendedTiltBedFaultTimer;
                 CANCEL TiltBed;
                 EXIT SELECT TBcontrolBlock;
        END DETECT;

        WAIT 250 MS;                            --for bi-directional motor
        nextTiltBedPosition ←  .preReg;          --same as park position
        tiltBedFaultTime ← 260 MS;
        tbFault ← .tbParkFlt;
        FBNIO.TILT$REV↑ ← .on;
        TiltBedCycle[];                         --move to park (pre-reg)
        IF NOT tiltBedFault THEN
           FBNEvents.tiltBedReady↑ ← .set;
           tiltBedReady ← TRUE;
        END IF;

      CASE tiltBedHomeJamTime:
         FBNIO.TILT$FWD↑ ← .off;
         START SSMgr.FaultHandler[.tbParkFlt, .set];

    END DETECT;
  ELSE
                                  --there is a set stuck in the tilt bed
      START SSMgr.FaultHandler[.setStuckInTiltBed, .set];
  END IF;

END SELECT TBcontrolBlock;

WILL
  FBNIO.TILT$FWD↑ ← .off;
```

```
      FBNIO.TILT$REV↑ ← .off;
      currentTiltBedPosition ← .unknown;
      CANCEL ExtendedTiltBedFaultTimer;
      CANCEL TiltPause;

  END PROCESS TiltBed;


--File:  BinderImpl  Process:TiltBedCycle
--=================================================================
--TiltBedCycle
--Tilt Bed Process calls this process to monitor the tilt bed position
--sensor and turns off both outputs when the transition is detected.
--Time stamps are taken at the start and end of the Tilt Bed movement
--to determine the motion time.  In some tilt bed cycles a minimum
--time is inserted in the process if the motion is done quicker than
--expected.
--Also, in some cycles, the process is allowed to continue even though
--the tilt bed did not reach the position in the minimum fault time.
--In those cases the Extended Tilt Bed Fault Time process is started
--to continue monitoring the position sensor, and the binder continues
--in the normal manner.
--=================================================================
TiltBedCycle: PROCEDURE[] =
  ENTER

    OS.ReadGlobalRTC[@tbTimeStamp1];                    --take first time stamp
    currentTiltBedPosition ← .unknown;

    DETECT

      CASE NEXTTIME FBNIO.TILT#POSB↑ = .low:
        FBNIO.TILT$FWD↑ ← .off;
        FBNIO.TILT$REV↑ ← .off;
        OS.ReadGlobalRTC[@tbTimeStamp2];                --take second time stamp
        tbMotionTime ← tbTimeStamp2 - tbTimeStamp1;
        START TiltPause[];

        IF tiltBedMinTime > tbMotionTime THEN
          tbCycleWaitTime ← tiltBedMinTime - tbMotionTime;
          WAIT tbCycleWaitTime;
        END IF;

      CASE tiltBedFaultTime:
        IF (tiltBedMaxTime > tiltBedFaultTime) AND
         (FBNIO.TILT#POSB↑ = .high) THEN
          extendedTiltBedTime ← tiltBedMaxTime - tiltBedFaultTime;
          START ExtendedTiltBedFaultTimer[];

        ELSE
          ---------------------------------------------------------
          -- If the tilt bed did not move at all, declare fault Immediately
          ---------------------------------------------------------
          FBNIO.TILT$FWD↑ ← .off;
          FBNIO.TILT$REV↑ ← .off;
          tiltBedDNMove ← TRUE;
          tiltBedFault ← TRUE;
          START SSMgr.FaultHandler[tbFault, .set];

        END IF;
    END DETECT;
  END PROCEDURE TiltBedCycle;
```

```
--File:  BinderImpl  Process: TiltPause
--=================================================================
--TiltPause[];
--This process waits before checking the Tilt Bed Sensor A to be sure
--that the tilt bed brake did not fail.
--=================================================================
TiltPause: PUBLIC PROCESS [] =

  ENTER
    OS.SetPriority[.low];

    WAIT tiltBedPauseTime;

    IF FBNIO.TILT#POSA↑ <> .low THEN
      START SSMgr.FaultHandler[.tbBrakeFlt, .set];
      tiltBedFault ← TRUE;
    ELSE
      currentTiltBedPosition ← nextTiltBedPosition;
      tiltBedFault ← FALSE;
    END IF;

    --=========================================================================
    --Tilt Bed Timing Measurements are sent up to the Subsystem Manager from
    --here. current In the case of the next position being Pre/Post Registration,
    --the differentiation between the move from load/unload to pre-reg and
    --reg/bind to pre-reg is the fault time.  If this fault time changes such
    --that they are equal, then the code will have to be restructured and a flag
    --added.
    --If the tilt bed faulted, fault times will be sent up, if it did not move,
    --zeroes will be sent up for motion time
    --=========================================================================
    IF tiltBedDNMove THEN
       tbMotionTime ← 0 MS;
    END IF;

      SELECT nextTiltBedPosition FROM
        CASE = .loadUnload:
          START SSMgr.DiagTimer[.tiltPostRegtoLoadUnld,tbMotionTime];

        CASE = .preReg:
          IF tiltBedFaultTime = tiltBedPreRegJamTime THEN
            START SSMgr.DiagTimer[.tiltLoadUnldToPreReg,tbMotionTime];
          ELSE
            START SSMgr.DiagTimer[.tiltRegToPostReg,tbMotionTime];
          END IF;

        CASE = .registration, = .binding:
          START SSMgr.DiagTimer[.tiltPreRegToBind, tbMotionTime];
      END SELECT;

  END PROCESS TiltPause;
```

```
-- File:  BinderImpl  Process:ExtendedTiltBedFaultTimer
--------------------------------------------------------------------
--ExtendedTiltBedFaultTimer[];
--This process is started when we wish to continue the binding
--process but must also continue to watch for the position sensors,
--since the Tilt Bed has not reached its proper position yet.  Both
--Forward and Reverse motors are turned off.
--------------------------------------------------------------------
ExtendedTiltBedFaultTimer: PUBLIC PROCESS[] =
  ENTER

    OS.SetPriority[.low];

    DETECT
      CASE ANYTIME FBNIO.TILT#POSB↑ = .low:
        FBNIO.TILT$FWD↑ ← .off;
        FBNIO.TILT$REV↑ ← .off;
        OS.ReadGlobalRTC[@tbTimeStamp2];
        tbMotionTime ← tbTimeStamp2 - tbTimeStamp1;
        START TiltPause[];

      CASE extendedTiltBedTime:                          --MS;
        FBNIO.TILT$FWD↑ ← .off;
        FBNIO.TILT$REV↑ ← .off;
        START SSMgr.FaultHandler[tbFault, .set];
        tiltBedFault ← TRUE;
    END DETECT;

    WILL
       FBNIO.TILT$FWD↑ ← .off;
       FBNIO.TILT$REV↑ ← .off;
       CANCEL TiltPause;
  END PROCESS ExtendedTiltBedFaultTimer;

--

-- File:  BinderImpl  Process:RegisterSet
--------------------------------------------------------------------
--This process turns on the Binder vibrator to fine register the set.
--Vibration will be done with two intensities:  HIGH AND LOW VIBRATION.
--The cycles are defined in Volume 1, section 10
--of the Control Requirements, section 2.1.7, Control Binder.
--AFTER THE LOW VIBRATION, THE SET SETTLES FOR XX MS.
--------------------------------------------------------------------
RegisterSet: PUBLIC PROCESS[] =

  ENTER
    OS.SetPriority[.high];

    FBNIO.VIB$FLWAVE↑ ← .on;
    WAIT RECAST[fullOn, REALTIME];
    FBNIO.VIB$FLWAVE↑ ← .off;

    FBNIO.VIB$HFWAVE↑ ← .on;
    WAIT RECAST[dutyCycle , REALTIME];
    FBNIO.VIB$HFWAVE↑ ← .off;

    WILL
      FBNIO.VIB$HFWAVE↑ ← .off;
      FBNIO.VIB$FLWAVE↑ ← .off;

  END PROCESS RegisterSet;
--
```

```
-- File:  BinderImpl  Process:Flappers
--=================================================================
--Flappers[FlapPosition]:
--This process cycles the Binder Flappers to the position indicated in
--the passed parameter.
--The flapper motor moves the flappers through their four positions:
--home, up to pre-registration, tape-in-bind, and up to flap/press the book.
--The motor is turned on, all the parameters for the move (minimum time,
--maximum times, etc.) are set up, and the FlapperCycle process is started
--to monitor the position sensor.
--
--=================================================================
Flappers: PUBLIC PROCESS[cycleNext: Binder.FlapPosition] =
  ENTER

    OS.SetPriority[.high];

    --Variable initializations
    flapMinTime ← 0 MS;
    flapMaxTime ← 0 MS;
    flapsONMove ← FALSE;

    --CLEAR FLAPPER HOME USER EVENT
    FBNEvents.flappersReady↑ ← .clear;

    FlapControlBlock: SELECT cycleNext FROM
      CASE = .home:
        IF currentFlapperPosition  = .flapping THEN
          nextFlapperPosition ← .home;
          flapFaultTime ← flapperHomeJamTime;
          flapFault ← .flapToHomeFlt;
          FlapperCycle[];
          FBNEvents.flappersReady↑ ← .set;
        ELSE
          START SSMgr.FaultHandler[.flapToHomeFlt, .set];
        END IF;

      CASE = .preReg:
        IF currentFlapperPosition  = .home THEN
          nextFlapperPosition ← .preReg;
          flapFaultTime ← flapperPreRegJamTime;
          flapMinTime ← 200 MS;
          flapMaxTime ← 300 MS;
          flapFault ← .flapPreregFlt;
          -- set flappersReady flag for the feedtape process.  it's okay to
          -- feed as long as the tape guides have not moved
          FBNEvents.flappersReady↑ ← .set;
          FlapperCycle[];

        ELSE                                        --we have lost our position
          START SSMgr.FaultHandler[.flapPreregFlt, .set];
        END IF;

      CASE = .tapeInBind:
        IF (currentFlapperPosition  = .preReg) THEN
          nextFlapperPosition ← .tapeInBind;
          flapFaultTime ← flapperTapeInJamTime;
          flapMinTime ← 520 MS;
          flapMaxTime ← 590 MS;
          flapFault ← .flapInBindFlt;
          FlapperCycle[];
```

```
      ELSE                                    --we have lost our position
          START SSMgr.FaultHandler[.flapInBindFlt, .set];
    END IF;

  CASE = .flapping:
    IF currentFlapperPosition  = .tapeInBind THEN
      nextFlapperPosition ← .flapping;
      flapFaultTime ← flapperFlappJamTime;
      flapMinTime ← 380 MS;
      flapMaxTime ← 460 MS;
      flapFault ← .flappingPosFlt;
      FlapperCycle[];
    ELSE                                      --we have lost our position
      START SSMgr.FaultHandler[.flappingPosFlt, .set];
    END IF;

  CASE = .initialize:
    IF FBNIO.FLAP#HOME↑ <> .low THEN                --if not at home
      currentFlapperPosition ← .unknown;
      FBNIO.FLAP$MTR↑ ← .on;

      DETECT

        CASE ANYTIME FBNIO.FLAP#HOME↑ = .low:       --at home
          FBNIO.FLAP$MTR↑ ← .off;
          WAIT 150 MS;                              --pause
          IF FBNIO.FLAP#HOME↑ <> .low THEN          --check if still at home
            START SSMgr.FaultHandler[.flapHomingFlt, .set];
            CANCEL FlapPause;
            CANCEL ExtendedFlapFaultTimer;
            EXIT SELECT FlapControlBlock;
          END IF;

         CASE flappersInitJamTime:
           FBNIO.FLAP$MTR↑ ← .off;
           START SSMgr.FaultHandler[.flapHomingFlt, .set];
           CANCEL FlapPause;
           CANCEL ExtendedFlapFaultTimer;
           EXIT SELECT FlapControlBlock;
       END DETECT;
     END IF;
     currentFlapperPosition ← .home;
     FBNEvents.flappersReady↑ ← .set;       --set user event, flappers are home

  END SELECT FlapControlBlock;

  WILL
    FBNIO.FLAP$MTR↑ ← .off;
    currentFlapperPosition ← .unknown;
    CANCEL FlapPause;
    CANCEL ExtendedFlapFaultTimer;
END PROCESS Flappers;
```

```
-- File:  BinderImpl  Process:FlapperCycle
--=================================================================
--This process is called by the Flapper Process to monitor the
--Flapper position sensor and turn off the Flapper motor output when the
--transition is detected.
--Time stamps are taken at the start and end of the flapper movement
--to determine the motion time.  In some cycles, a minimum time is inserted
--in the process if the motion is done quicker than expected.
--Also, in some cycles the binding process is allowed to continue even
--though the flappers did not reach the position in the minimum fault time.
--In those cases ExtendedFlapFaultTimer is started to
--continue monitoring the sensor.
--=================================================================
FlapperCycle: PROCEDURE[] =

  ENTER.
    currentFlapperPosition ← .unknown;
    OS.ReadGlobalRTC[@flapTimeStamp1];                    --take first time stamp

    FBNIO.FLAP$MTR↑ ← .on;
    ---------------------------------------------------------------
    -- Check to be sure that the flappers did move off of the sensor
    ---------------------------------------------------------------
    WAIT 100 MS;

    IF FBNIO.FLAP#POS↑ = .low THEN
       FBNIO.FLAP$MTR↑ ← .off;
       flapsDNMove ← TRUE;
       START SSMgr.FaultHandler[flapFault, .set];

    END IF;
    ---------------------------------------
    --All the Flap Fault Times are > 100
    ---------------------------------------
    flapFaultTime ← flapFaultTime - 100 MS;

    DETECT

      CASE NEXTTIME FBNIO.FLAP#POS↑ = .low:
        FBNIO.FLAP$MTR↑ ← .off;
        OS.ReadGlobalRTC[@flapTimeStamp2];
        flapMotionTime ← flapTimeStamp2 - flapTimeStamp1;
        START FlapPause[];
        IF flapMinTime > flapMotionTime THEN
          flapCycleWaitTime ← flapMinTime - flapMotionTime;
          WAIT flapCycleWaitTime;
        END IF;

      CASE flapFaultTime:
        IF (flapMaxTime > flapFaultTime) THEN
          extendedFlapTime ← flapMaxTime - flapFaultTime;
          START ExtendedFlapFaultTimer[];
        ELSE
          FBNIO.FLAP$MTR↑ ← .off;
          START SSMgr.FaultHandler[flapFault, .set];
        END IF;
    END DETECT;
  END PROCEDURE FlapperCycle;

--
```

```
-- File:  BinderImpl  Process:FlapPause
--=================================================================
--This process waits before checking the Flapper Position sensor to
--be sure the brake or other hardware in the Flappers did not fail.
--=================================================================
FlapPause: PUBLIC PROCESS[] =

  ENTER
    OS.SetPriority[.low];

    WAIT flapperPauseTime;
    IF FBNIO.FLAP#POS↑ <> .low THEN
      START SSMgr.FaultHandler[.flapBrakeFlt, .set];
    ELSE
      currentFlapperPosition ← nextFlapperPosition;
    END IF;

    --=================================================================
    --Flapper Timing Measurements are sent up to the Subsystem Manager from
    --here. The initialization cycle is not timed.  If the flappers faulted,
    --the fault times will be displayed.  If it did not move, zeroes will be sent
    --=================================================================

    IF flapsDNMove THEN
       flapMotionTime ← 0 MS;
    END IF;

     SELECT nextFlapperPosition FROM
        CASE = .home:
          START SSMgr.DiagTimer[.flapFlappingToHome, flapMotionTime];
        CASE = .preReg:
          START SSMgr.DiagTimer[.flapHomeToPreReg, flapMotionTime];
        CASE = .tapeInBind:
          START SSMgr.DiagTimer[.flapPreRegToTapeIn, flapMotionTime];
        CASE = .flapping:
          START SSMgr.DiagTimer[.flapTapeInToFlapping, flapMotionTime];
      END SELECT;
  END PROCESS FlapPause;

-- File:  BinderImpl  Process:ExtendedFlapFaultTimer
--=================================================================
--ExtendedFlapFaultTimer[];
--This process is started when we wish to continue the binding
--process but must also continue to watch for the flapper position
--sensor, since the flappers have not reached its proper position yet.
--=================================================================
ExtendedFlapFaultTimer: PUBLIC PROCESS[] =

  ENTER
    OS.SetPriority[.low];

    DETECT
      CASE ANYTIME FBNIO.FLAP#POS↑ = .low:
        FBNIO.FLAP$MTR↑ ← .off;
        OS.ReadGlobalRTC[@flapTimeStamp2];
        flapMotionTime ← flapTimeStamp2 - flapTimeStamp1;
        START FlapPause[];

      CASE extendedFlapTime:
        FBNIO.FLAP$MTR↑ ← .off;
        START SSMgr.FaultHandler[flapFault, .set];
    END DETECT;
    WILL
      FBNIO.FLAP$MTR↑ ← .off;
      CANCEL FlapPause;
  END PROCESS ExtendedFlapFaultTimer;

--
```

```
-- File: TimingImpl  Process: DiagTimer
--=========================================================================
-- The DiagTimer proces is started by the I/O subsystems each time a
-- measurable interval elapses in the finisher (sheet from point A to B, e.g.).
-- It records an almost jam for that interval if the time reported is over a
-- constant threshold value.


--=========================================================================
DiagTimer: PUBLIC PROCESS [int: Env.Interval, intTime: UNSPECIFIED] =

  nominal, upperLimit, lowerLimit: UNSPECIFIED;
  range: JMNfromALL.RangeFlag;
  normalizedTime: UNSPECIFIED;
  index: SHORT UNSPECIFIED;

ENTER  --DiagTimer

  OS.SetPriority[.low];

  --=========================================================================
  --set up nominal time and upper and lower limits for this interval
  --=========================================================================
  index ← ORD[int] - 100;
  SELECT int FROM
    CASE = .lefinEntToLEpstInvJamInv:
      nominal ← Sched.invertedNomTime;
    CASE = .lefinEntToTEfinEnt,
         = .leregInToTEregInTray,
         = .leregIntoTEregInBins:
      nominal ← Sched.nominalShPathTETime;
    CASE = .lebinAEntToTEbinAEnt,
         = .lebinBEntToTEbinBEnt,
         = .lebinCEntToTEbinCEnt:
      nominal ← Sched.nominalBinTETime;
    OTHERWISE:
      nominal ← nominalValues[index];
  END SELECT;
  upperLimit ← nominal + nominalOffsetsPlus[index];
  lowerLimit ← nominal - nominalOffsetsMinus[index];

--
-- File: TimingImpl  Process: DiagTimer
  --=========================================================================
  --normalize interval time relative to interval nominal value
  --=========================================================================
  IF intTime > nominal THEN
    normalizedTime ← intTime - nominal;
  ELSE
    normalizedTime ← nominal - intTime;
  END IF;

  --=========================================================================
  --check to see if measured time was within normal range
  --=========================================================================
  SELECT intTime FROM
    CASE < lowerLimit:
      range ← .belowNominalOutOfRange;
    CASE < nominal:
      range ← .belowNominalInRange;
    CASE <upperLimit:
      range ← .aboveNominalInRange;
    OTHERWISE: --over upper limit
```

```
      range ← .aboveNominalOutOfRange;
      IF (CallMgmt.almostJams[index] < 16#FFFF) AND (index < 32) AND

      ----------------------------------------------------------------
      -- Don't count the set Xport times as almost jams
      ----------------------------------------------------------------

       ((index <> 14) AND (index <> 15) AND (index <> 18) AND (index <> 21) AND
       (index <>22))  THEN

        CallMgmt.almostJams[index] ← CallMgmt.almostJams[index] + 1;
      END IF;
  END SELECT;

-- File: FaultImpl   Process: FaultHandler
        ----------------------------------------------------------------
        --Fault is being set: Don't set more than one fault in a zone.  Start the
        --appropriate type of shutdown for that zone, declare the fault, and
        --set the zone Jam flag.
        ----------------------------------------------------------------
        SELECT faultID FROM

          --tilt bed Jam
          CASE >= ORD[SSMgr.Faults.tbPreregFlt]:
            IF NOT tiltBedJam OR (Faults[faultID] <> .clear) THEN
              START FBNfromMLT.ShutDown[FaultTypes[faultID], .fbn];
              SetFault[];
              tiltBedJam ← TRUE;
            END IF;

          --binder Jam
          CASE >= ORD[SSMgr.Faults.tapeHomeFlt]:
            IF NOT binderJam OR (Faults[faultID] <> .clear) THEN
              START FBNfromMLT.ShutDown[FaultTypes[faultID], .fbn];
              SetFault[];
              binderJam ← TRUE;
            END IF;

-- File:  FaultImpl
--------------------------------------------------------------------------
--Local Prodedure SetFault:
--This procedure sets the appropriate byte in the fault table to the fault sense,
--and informs the JMN.
--------------------------------------------------------------------------
  SetFault: PROCEDURE =

  ENTER  --SetFault
    Faults[faultID] ← sense;
    START JMNfromFBN.FBNFaultManager [.fbn, VAL[faultID], RECAST[sense]];
    IF sense = .set THEN
      CountFault[];
    END IF;
  END PROCEDURE SetFault;

--------------------------------------------------------------------------
-- Enter Main Body of FaultHandler
--------------------------------------------------------------------------
  ENTER
    OS.SetPriority[.low];
    faultID ← ORD[id];
    IF (Faults[faultID] <> sense) AND (sense <> .count) THEN
      IF sense = .set THEN
--
```

```
-- File: FaultImpl   Process: FaultHandler
--=============================================================================
-- The fault handler receives a fault ID and a fault sense from the I/O processes
-- that detect and clear faults.  It maintains an array of the faults, indicating
-- which faults are currently active, and informs the JMN of all fault
-- information.
--
-- FBN detailed design reference: Section 2.1.6
--=============================================================================
FaultHandler: PUBLIC PROCESS [id: SSMgr.Faults,
                              sense: SSMgr.FaultSense] =

  faultID: SHORT UNSPECIFIED;

--=============================================================================
--Local Prodedure CountFault:
--This procedure logs a fault occurrance in an NVM counter.
--It will not count 'coast' faults (faults that change from one code to another at
--idle),
--=============================================================================
  CountFault: PROCEDURE =

  ENTER  --CountFault
    IF (CallMgmt.faultCounters[faultID] < 255) AND
       (id <> .f1LEJamF1Cov) AND
       (id <> .f1LEJamF2Cov) AND
       (id <> .f1TEJamF1Uncov) AND
       (id <> .f5TEJamF5Uncov) AND
       (id <> .f5LEJamF5Cov) THEN
      CallMgmt.faultCounters[faultID] ← CallMgmt.faultCounters[faultID] + 1;
      START HI.BulkMemory[@CallMgmt.faultCounters[faultID], 1];
    END IF;
  END PROCEDURE CountFault;
--

-- File: CallMgmtImpl   Process: NVMCounterCmd
--=============================================================================
--  PROCESS: NVMCounterCmd
--
--  PASSED PARAMETERS
--    cmd:       Byte indicating which Call Management command to execute.
--    id:        The ID of the HFSI counter to be reset for a .resetHFSI command.
--    compLifeId: component life id
--
--  LOCAL PROCEDURES
--
--
--
--
--    ComputeMCBAJ
--
--    ComputeTop15MCBAJ
--    DebugPrinter
--
--  DESCRIPTION
--    This process performs all of the calculations and reporting tasks associated
--    with the tech rep call management diagnostic.
--
-- FBN detailed design reference: Section 3.x
--=============================================================================
NVMCounterCmd: PUBLIC PROCESS [cmd: CallMgmt.CounterCommand,
                               id: FBNfromJMN.FbnHfsiCounter,
                               compLifeId: SHORT UNSPECIFIED] =

--=============================================================================
--Local Data
--=============================================================================
```

```
--loop counter for temporary use.
  loopCnt: SHORT UNSPECIFIED;

--constants for nvm start address and length.
  nvmStartAddress: UNSPECIFIED = 16#7800;
  nvmLength:       UNSPECIFIED = 1024;

--constants identifying page that local data is on and root page for public data.
  page: SHORT UNSPECIFIED = 2;
  pubData: SHORT UNSPECIFIED = 1;

-- File: CallMgmtImpl   Process: NVMCounterCmd/ComputeMCBAJ
--==============================================================================
--  LOCAL PROCEDURE: ComputeMCBAJ
--
--  DESCRIPTION
--    This procedure calculates a mean-copies-between almost jam rate for each
--    almost jam that is detected by this node.
--==============================================================================
ComputeMCBAJ: PROCEDURE [] =

--==============================================================================
--Local Data
--==============================================================================

--loop counter for temporary use.
  loopCnt: SHORT CARDINAL;

--temporary variable to store most-significant-word of calculation before
--translating it to a byte.
  msw: UNSPECIFIED;

ENTER  -- ComputeMCBAJ

  --============================================================================
  --Loop through almost jam counters, calculating a mean-copies-between almost
  --jam rate for each almost jam.  The rate is based on a different event counter
  --for each almost jam. The event counter is referenced through the
  --almostJamEvents array.
  --set rate to FFFFFF for any jam or almost jam counter that has not jams logged
  --so that history files don't show zero mean copies between jams

  --============================================================================
  FOR loopCnt ← 0 UPTO maxAlmostJams LOOP

    IF almostJamEvents[loopCnt] <> VAL[16#FF] THEN
      IF CallMgmt.almostJams[loopCnt] = 0 THEN
        highByteMCBAJ[loopCnt] ← 16#FF;
        lowWordMCBAJ[loopCnt] ← 16#FFFF;
      ELSE
        [msw, lowWordMCBAJ[loopCnt]] ← Math.DivDword[
                NORMAL[CallMgmt.highByteEvents[ORD[almostJamEvents[loopCnt]]]],
                CallMgmt.lowWordEvents[ORD[almostJamEvents[loopCnt]]],
                CallMgmt.almostJams[loopCnt]];
        highByteMCBAJ[loopCnt] ← SHORT[msw];
      END IF;
    ELSE
      highByteMCBAJ[loopCnt] ← 0;
      lowWordMCBAJ[loopCnt] ← 0;
    END IF;

  END LOOP;

END PROCEDURE ComputeMCBAJ;
--
```

```
-- File: CallMgmtImpl   Process: NVMCounterCmd/ComputeTop15MCBAJ
--=============================================================================
--  LOCAL PROCEDURE: ComputeTop15MCBAJ
--
--  DESCRIPTION
--    This procedure sorts through the mean-copies-between almost jams array and
--    picks out the top 15 (smallest rates) items. The almost jam ID's
--    corresponding to these top 15 faults are stored in an array that is sent to
--    SAN.
--=============================================================================
ComputeTop15MCBAJ: PROCEDURE [] =

--=============================================================================
--Local Data
--=============================================================================

--The last rate that was stored in the top 15 array and the smallest rate found
--in each pass through the mcbaj array are stored temporarily during the sort.
  lastRateLSW, smallestRateLSW: UNSPECIFIED;
  lastRateMSB, smallestRateMSB: SHORT UNSPECIFIED;

--The mcbajIndex is the almost jam ID that is found and entered as the next item
--in the top 15 array.  The lastIndex is the last one that was found (in the
--previous pass through the mcbj array.
  mcbajIndex, lastIndex: SHORT UNSPECIFIED;

--These variables are loop counters for looping through the top 15 array and for
--looping through the mcbaj array.
  countTo15, mcbajCnt: SHORT CARDINAL;

ENTER  -- ComputeTop15MCBAJ

  --=========================================================================
  --Initialize variables prior to sorting through mcbaj array.
  --=========================================================================
  lastRateLSW ← 0;
  lastRateMSB ← 0;
  lastIndex ← 16#FF;
  mcbajIndex ← 0;

  --=========================================================================
  --Loop through top 15 almost jams array and insert the almost jam ID with the
  --next highest associated almost jam rate into each entry.
  --=========================================================================
  FOR countTo15 ← 0 UPTO 14 LOOP

    IF mcbajIndex = 16#FF THEN
      smallestRateLSW ← 0;
      smallestRateMSB ← 0;
    ELSE
      smallestRateLSW ← 16#FFFF;
      smallestRateMSB ← 16#FF;
    END IF;
    mcbajIndex ← 16#FF;
-- File: CallMgmtImpl   Process: NVMCounterCmd/ComputeTop15MCBAJ
    --=========================================================================
    --Loop through mcbaj array to pick out the next lowest almost jam rate.
    --=========================================================================
    FOR mcbajCnt ← 0 UPTO maxAlmostJams LOOP

        --rate <> 0
      IF (NOT((lowWordMCBAJ[mcbajCnt] = 0) AND (highByteMCBAJ[mcbajCnt] = 0))) AND

        --rate <> FFFFFF
        (NOT((lowWordMCBAJ[mcbajCnt] = 16#FFFF) AND
             (highByteMCBAJ[mcbajCnt] = 16#FF))) AND
```

```
        --rate >= last rate
        (((highByteMCBAJ[mcbajCnt] > lastRateMSB) OR
          ((highByteMCBAJ[mcbajCnt] = lastRateMSB) AND
           (lowWordMCBAJ[mcbajCnt] > lastRateLSW))) OR
         (((lowWordMCBAJ[mcbajCnt] = lastRateLSW) AND
           (highByteMCBAJ[mcbajCnt] = lastRateMSB)) AND
          (mcbajCnt > lastIndex))) AND

        --rate <= smallest rate
        (((highByteMCBAJ[mcbajCnt] < smallestRateMSB) OR
          ((highByteMCBAJ[mcbajCnt] = smallestRateMSB) AND
           (lowWordMCBAJ[mcbajCnt] < smallestRateLSW))) OR
         (((lowWordMCBAJ[mcbajCnt] = smallestRateLSW) AND
           (highByteMCBAJ[mcbajCnt] = smallestRateMSB)) AND
          (mcbajCnt > lastIndex))) AND

        --haven't picked one at this rate yet
        ((NOT((highByteMCBAJ[mcbajIndex] = highByteMCBAJ[mcbajCnt]) AND
             (lowWordMCBAJ[mcbajIndex] = lowWordMCBAJ[mcbajCnt]))) OR
         (mcbajIndex = 16#FF)) AND

        --valid almost jam
        (almostJamEvents[mcbajCnt] <> VAL[16#FF]) THEN

       mcbajIndex ← mcbajCnt;
       smallestRateMSB ← highByteMCBAJ[mcbajCnt];
       smallestRateLSW ← lowWordMCBAJ[mcbajCnt];
     END IF;

   END LOOP;

   ------------------------------------------------------------------------
   --Insert almost jam ID found into the top 15 array.
   ------------------------------------------------------------------------
   top15AlmostJams[countTo15] ← mcbajIndex;
   IF mcbajIndex = 16#FF THEN
     top15AJCount[countTo15] ← 0;
   ELSE
     top15AJCount[countTo15] ← CallMgmt.almostJams[mcbajIndex];
   END IF;
   lastRateLSW ← lowWordMCBAJ[mcbajIndex];
   lastRateMSB ← highByteMCBAJ[mcbajIndex];
   lastIndex ← mcbajIndex;

 END LOOP;

END PROCEDURE ComputeTop15MCBAJ;
```

1. In a reproduction machine having plural discretely operating copy producing components synchronously operable in timed sequence with one another to produce copies, the combination of:

(a) first fault timing means for tolling a preset timed interval delimiting the copy producing cycle of at least one of said components of said machine, said first fault timing means on failure of said one component to complete its copy producing cycle within said preset timed interval enabling stopping said machine;

(b) second fault timing means adapted to intervene and delay stopping of said machine by said first fault timing means for a relatively short almost jam interval, said almost jam interval providing extra time for said one component to complete its copy producing cycle in an attempt to avoid the need to stop said machine, said second fault timing means on failure of said one component to complete its copy producing cycle within said almost jam interval enabling stopping said machine.

2. The machine according to claim 1 including recording means for recording each of said almost jams whereby to provide a record of said almost jams for use in servicing said machine.

3. In a reproduction machine having plural discretely operating copy producing components operable in timed sequence with one another to produce copies, the combination of:

(a) first fault timing means for tolling a preset operating timed interval for the copy producing cycle of at least one of said components, said first fault timing means on failure of said one component to complete its copy producing cycle within said preset timed interval providing a fault signal enabling stopping said machine;

(b) second fault timing means adapted to extend said preset timed interval by an additional relatively short second timed interval in an attempt to allow said one component to complete its copy producing cycle and avoid the need to stop said machine, said second fault timing means on failure of said one component to complete its copy producing cycle within said second timed interval providing a fault signal enabling stopping said machine.

4. The machine according to claim 3 including recording means for recording the number of times said second fault means responds.

5. In a reproduction machine having a copying section for producing copies of documents and an on-line binding section for binding said copies as said copies are produced into books, said binding section having plural discretely operating binding components synchronously operable with said copying section in a preset binding cycle to assemble a preselected number of said copies, bind said assembled copies to form a book, and eject the finished book preparatory to binding the next book, the combination of:

(a) jam detecting means for tolling a timed interval for delineating the operating cycle of at least one of said binding section components, said jam detecting means on failure of said one component to complete its binding cycle within said timed interval enabling interruption of said binding section to prevent a jam, (b) almost jam means adapted to intervene and delay interruption of said binding section by said jam detecting means, said almost jam means tolling an additional relatively short almost jam interval adapted to extend said timed interval and allow said one component to complete its binding cycle even though said timed interval is exceeded whereby to avoid interruption of said binding section and binding of said books, said almost jam means on failure of said one component to complete its binding cycle within said additional almost jam interval enabling interruption of said binding section to prevent a jam.

6. The machine according to claim 5 including means for recording each time said one component exceeds said timed interval.

7. The machine according to claim 6 including means for recording each time said almost jam means intervenes to delay interruption of said binding section by said jam detecting means.

* * * * *